US010532857B1

(12) United States Patent
Haldiman

(10) Patent No.: US 10,532,857 B1
(45) **Date of Patent: *Jan. 14, 2020**

(54) STOPPERS, STOPPER AND FLUID TUBE ASSEMBLIES, AND CONTAINER ASSEMBLIES FORMED THEREWITH

(71) Applicant: Joseph C. Haldiman, Black Canyon City, AZ (US)

(72) Inventor: Joseph C. Haldiman, Black Canyon City, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/386,027

(22) Filed: Apr. 16, 2019

Related U.S. Application Data

(63) Continuation of application No. 15/936,957, filed on Mar. 27, 2018, now Pat. No. 10,329,054.

(51) Int. Cl.

| | |
|---|---|
| ***B65D 39/00*** | (2006.01) |
| ***B65D 47/06*** | (2006.01) |
| ***B65D 47/24*** | (2006.01) |
| ***B67D 3/00*** | (2006.01) |
| ***B65D 51/16*** | (2006.01) |

(52) U.S. Cl.
CPC ..... *B65D 39/0029* (2013.01); *B65D 47/06* (2013.01); *B65D 47/243* (2013.01); *B65D 51/1688* (2013.01); *B67D 3/0051* (2013.01)

(58) Field of Classification Search
CPC .. B65D 39/0029; B65D 47/06; B65D 47/243; B65D 51/1688
USPC ..... 222/321.7
See application file for complete search history.

(56) References Cited

U.S. PATENT DOCUMENTS

| | | | |
|---|---|---|---|
| 2,628,736 | A | 2/1953 | Warneke |
| 2,800,241 | A | 7/1957 | Brune et al. |
| 3,422,998 | A | 1/1969 | Murray |
| 3,630,419 | A | 12/1971 | Pierce |
| 3,670,915 | A | 6/1972 | Forman |
| 3,966,099 | A | 6/1976 | Sanford, Jr. et al. |
| 5,072,861 | A | 12/1991 | Jou |
| 5,397,027 | A | 3/1995 | Koch et al. |
| 5,799,836 | A | 9/1998 | Lee |
| 8,556,136 | B2 | 10/2013 | Huynh |
| 8,657,157 | B2 | 2/2014 | Blinn |
| 9,254,944 | B1 | 2/2016 | Peckels |
| 9,394,089 | B2 | 7/2016 | Silvers et al. |
| 2003/0047531 | A1 | 3/2003 | Wong |
| 2007/0199612 | A1 | 8/2007 | Larimer et al. |
| 2008/0290118 | A1 | 11/2008 | Luzaich et al. |

(Continued)

FOREIGN PATENT DOCUMENTS

DE 4112610 A1 10/1992

*Primary Examiner* — Jeremy Carroll
(74) *Attorney, Agent, or Firm* — Michael W. Goltry; Robert A. Parsons; Parsons & Goltry, PLLC

(57) ABSTRACT

A stopper has a head part and a stopper part. The stopper part extends from the head part to a lower end and has flanges, between the head part and the lower end, that have different diameters that increase from the head part to the lower end of the stopper part. A container has a mouth and neck and shoulder inner surfaces. The stopper part is inserted into the container through the mouth, the head part remains outside the mouth, at least one of the flanges proximate neck sealingly engages the neck inner surface, and at least one of the flanges proximate to the shoulder sealing engages the shoulder inner surface. A fluid tube is retained by the stopper. The fluid tube extends from an inlet within the container outwardly through the mouth to an outlet outside the container.

11 Claims, 32 Drawing Sheets

(56) References Cited

U.S. PATENT DOCUMENTS

| | | | |
|---|---|---|---|
| 2010/0230447 | A1 | 9/2010 | Eriksen |
| 2012/0074172 | A1 | 3/2012 | Federighi |
| 2012/0211516 | A1 | 8/2012 | Zapp et al. |
| 2014/0175100 | A1 | 6/2014 | Foresman et al. |
| 2015/0251822 | A1 | 9/2015 | Slevin et al. |
| 2015/0321802 | A1 | 11/2015 | Shpakow |
| 2016/0114945 | A1 | 4/2016 | Carsello et al. |
| 2016/0229604 | A1 | 8/2016 | Carsello et al. |
| 2016/0332786 | A1 | 11/2016 | Schoen |

STOPPERS, STOPPER AND FLUID TUBE ASSEMBLIES, AND CONTAINER ASSEMBLIES FORMED THEREWITH

FIELD OF THE INVENTION

The present invention relates to containers for holding fluids and, more particularly, to portable container assemblies for holding and dispensing fluids, such as beverages and liquid preparations.

BACKGROUND OF THE INVENTION

Portable containers of the type for holding and dispensing fluids are commonly used in the fields of beverages and liquid preparations, such as liquid cleansers, soaps, conditioners, shampoos, lotions, and the like. A typical portable container for holding liquid contents is the type having made of glass or plastic and that includes a neck that extends downwardly from a mouth to a shoulder that extends outwardly and downwardly to a container body defined by a sidewall having a closed bottom. Since containers of this type are reusable, and often designed to be reusable, skilled artisans have devoted considerable effort toward the development of closure assemblies useful for not only closing the container mouth but also effectuating withdrawal of the liquid contents of the container. However, current efforts have not yielded entirely acceptable results. For instance, some closure assemblies are rudimentary and inadequate. While others are needlessly expensive, difficult to construct, structurally complex, and fail to adequately close the container mouth while at the same time enabling a convenient withdrawal of the liquid contents from the container. Given these and other deficiencies inherent in the art, the need for continued improvement is evident.

SUMMARY OF THE INVENTION

According to the principle of the invention, a container assembly includes a container and a stopper. The container includes a body, which includes a mouth, a neck, a shoulder, and defines a volume for receiving and holding fluid contents through the mouth. The neck includes a neck inner surface, an upper end that defines the mouth, and a lower end. The neck, including the neck inner surface, extends downwardly from the upper end of the neck to the lower end of the neck. The shoulder includes a shoulder inner surface, an upper end connected to the lower end of the neck, and a lower end. The shoulder, including the shoulder inner surface, extends downwardly and outwardly from the upper end of the shoulder to the lower end of the shoulder. The stopper includes a head part and a stopper part. The head part includes an upper end, a lower end, and an outer surface. The head part, including the outer surface of the head part, concurrently extend downwardly from the upper end of the head part to the lower end of the head part. The stopper part includes an upper end, a lower end, an outer surface, and flanges. The stopper part, including the outer surface of the stopper part, concurrently extend downwardly from the upper end of the stopper part connected to the lower end of the head part to the lower end of the stopper part. Each flange radiates outwardly from the outer surface of the stopper part to an outer periphery that defines an outer diameter. The flanges are spaced apart from proximate to the upper end of the stopper part to proximate to the lower end of the stopper part, and the outer diameters of the flanges are different from one another and increase from an innermost one of the flanges proximate to the upper end of the stopper part to a lowermost one of the flanges proximate to the lower end of the stopper part. The stopper part is inserted into the volume through the mouth. The head part is outside the mouth and extends outwardly from the lower end of the head part, juxtaposed to the mouth, to the upper end of the head part. The stopper part extends downwardly into the volume through the neck from the upper end of the stopper part proximate to the mouth to the lower end of the stopper part beyond the lower end of the neck. At least a first one of the flanges proximate to the neck extends outwardly from the outer surface of the stopper part to the outer periphery thereof engaged sealingly to the neck inner surface, and at least a second one of the flanges proximate to the shoulder extends outwardly from the outer surface of the stopper part to the outer periphery thereof engaged sealingly to the shoulder inner surface. The outer diameter of the at least first one of the flanges is less than the outer diameter of the at least second one of the flanges, and the at least first one of the flanges and the at least second one of the flanges hold the stopper to the neck inner surface and to the shoulder inner surface, respectively. The lower end of the head part sealingly engages the upper end of the neck that defines the mouth between the outer surface of the head part and the inner surface of the head part. The head part further includes an inner surface that extends downwardly from the upper end of the head part to the lower end of the head part. The stopper part further includes an inner surface that extends downwardly from the upper end of the stopper part connected to the lower end of the head part to the lower end of the stopper part. The upper end of the head part defines an upper opening of the head part. The lower end of the stopper part defines a lower opening of the stopper part. The inner surface of the head part and the inner surface of the stopper part define a channel, and the channel extends from the lower opening of the stopper part to the upper opening of the head part. A fluid tube includes a continuous sidewall having an inner surface that defines a fluid transfer path, an outer surface, a proximal end that forms an outlet, and an opposing distal end that forms an inlet, and the outlet and the inlet enable fluid to pass through the fluid transfer path from the distal end to the proximal end. The fluid tube extends upright from the distal end to the proximal end through the channel of the stopper. The inner surface of the stopper part between head part and the lower end of the stopper part frictionally engages the outer surface of the fluid tube between the lower end of the stopper part and the head part frictionally retaining and sealing the fluid tube to the stopper, and the fluid tube enables fluid contents to be withdrawn from the volume of the container via the fluid transfer path from the inlet of the fluid tube to the outlet of the fluid tube. The inner surface of the head part defines a frustum, a basal part of a cone, that extends outwardly and upwardly from the outer surface of the fluid tube proximate to the lower end of the head part to the upper opening of the head part. The fluid tube includes a frustoconical outer periphery conformingly engaging the frustum of the head part. A breather hole extends through the head part from the inner surface of the head part, between the upper end of the head part and the lower end of the head part, to the lower end of the head part to the volume at the mouth between the neck inner surface and the outer surface of the stopper part for regulating pressure between the volume and an external environment. The outlet of the proximal end of the fluid tube is coupled in fluid communication to a fluid dispensing mechanism. The fluid dispensing mechanism includes a housing in direct contact against the upper end of the head part closing the upper opening of the head part. The stopper is fashioned of an elastomer.

According to the principle of the invention, a stopper includes a head part and a stopper part. The head part includes an upper end, a lower end, and an outer surface. The head part, including the outer surface of the head part, extend downwardly from the upper end of the head part to the lower end of the head part. The stopper part includes an upper end, a lower end, an outer surface, and flanges. The stopper part, including the outer surface of the stopper part, extend downwardly from the upper end of the stopper part connected to the lower end of the head part to the lower end of the stopper part. Each flange radiates outwardly from the outer surface of the stopper part to an outer periphery that defines an outer diameter. The flanges are spaced apart from proximate to the upper end of the stopper part to proximate to the lower end of the stopper part, and the outer diameters of the flanges are different from one another and increase from an innermost one of the flanges proximate to the upper end of the stopper part to a lowermost one of the flanges proximate to the lower end of the stopper part. The head part further includes an inner surface that extends downwardly from the upper end of the head part to the lower end of the head part. The stopper part further includes an inner surface that extends downwardly from the upper end of the stopper part to the lower end of the stopper part. The upper end of the head part defines an upper opening of the head part. The lower end of the stopper part defines a lower opening of the stopper part. The inner surface of the head part and the inner surface of the stopper part define a channel, and the channel extends from the lower opening of the stopper part to the upper opening of the head part. The inner surface of the head part defines a frustum, the basal part of a cone, that extends outwardly and upwardly from the lower end of the head part to the upper opening of the head part. A breather hole extends through the head part from the inner surface of the head part, between the upper end of the head part and the lower end of the head part, to the lower end of the head part between the outer surface of the head part and the outer surface of the stopper part. The stopper is fashioned of an elastomer.

According to the principle of the invention, a stopper and fluid tube assembly includes a fluid tube and a stopper. The fluid tube includes a continuous sidewall having an inner surface that defines a fluid transfer path, an outer surface, a proximal end that forms an outlet, and an opposing distal end that forms an inlet. The outlet and the inlet enable fluid to be drawn through the fluid transfer path from the distal end to the proximal end. The stopper includes a head part and a stopper part. The head part includes an upper end, a lower end, an outer surface, and an inner surface. The head part, including the outer surface of the head part and the inner surface of the head part, extend downwardly from the upper end of the head part to the lower end of the head part. The stopper part includes an upper end, a lower end, an outer surface, an inner surface, and flanges. The stopper part, including the outer surface of the stopper part and the inner surface of the stopper part, extend downwardly from the upper end of the stopper part connected to the lower end of the head part to the lower end of the stopper part. Each flange radiates outwardly from the outer surface of the stopper part to an outer periphery that defines an outer diameter. The flanges are spaced apart from proximate to the upper end of the stopper part to proximate to the lower end of the stopper part. The outer diameters of the flanges are different from one another and increase from an innermost one of the flanges proximate to the upper end of the stopper part to a lowermost one of the flanges proximate to the lower end of the stopper part. The upper end of the head part defines an upper opening of the head part. The lower end of the stopper part defines a lower opening of the stopper part. The inner surface of the head part and the inner surface of the stopper part define a channel, the channel extends from the lower opening of the stopper part to the upper opening of the head part. The fluid tube extends upright from the distal end to the proximal end through the channel of the stopper. The inner surface of the stopper part between head part and the lower end of the stopper part frictionally engages the outer surface of the fluid tube between the lower end of the stopper part and the head part frictionally retaining and sealing the fluid tube to the stopper, and the fluid tube enables fluid contents to be withdrawn from the volume of the container via the fluid transfer path from the inlet of the fluid tube to the outlet of the fluid tube. The inner surface of the head part defines a frustum, the basal part of a cone, that extends outwardly and upwardly from the outer surface of the fluid tube proximate to the lower end of the head part to the upper opening of the head part. The fluid tube includes a frustoconical outer periphery conformingly engaging the frustum of the head part. A breather hole extends through the head part from the inner surface of the head part, between the upper end of the head part and the lower end of the head part, to the lower end of the head part between the outer surface of the head part and the outer surface of the stopper part. The outlet of the proximal end of the fluid tube is coupled in fluid communication to a fluid dispensing mechanism. The fluid dispensing mechanism includes a housing in direct contact against the upper end of the head part closing the upper opening of the head part. The stopper is fashioned of an elastomer.

BRIEF DESCRIPTION OF THE DRAWINGS

Referring to the drawings.

DETAILED DESCRIPTION

Figure 4:
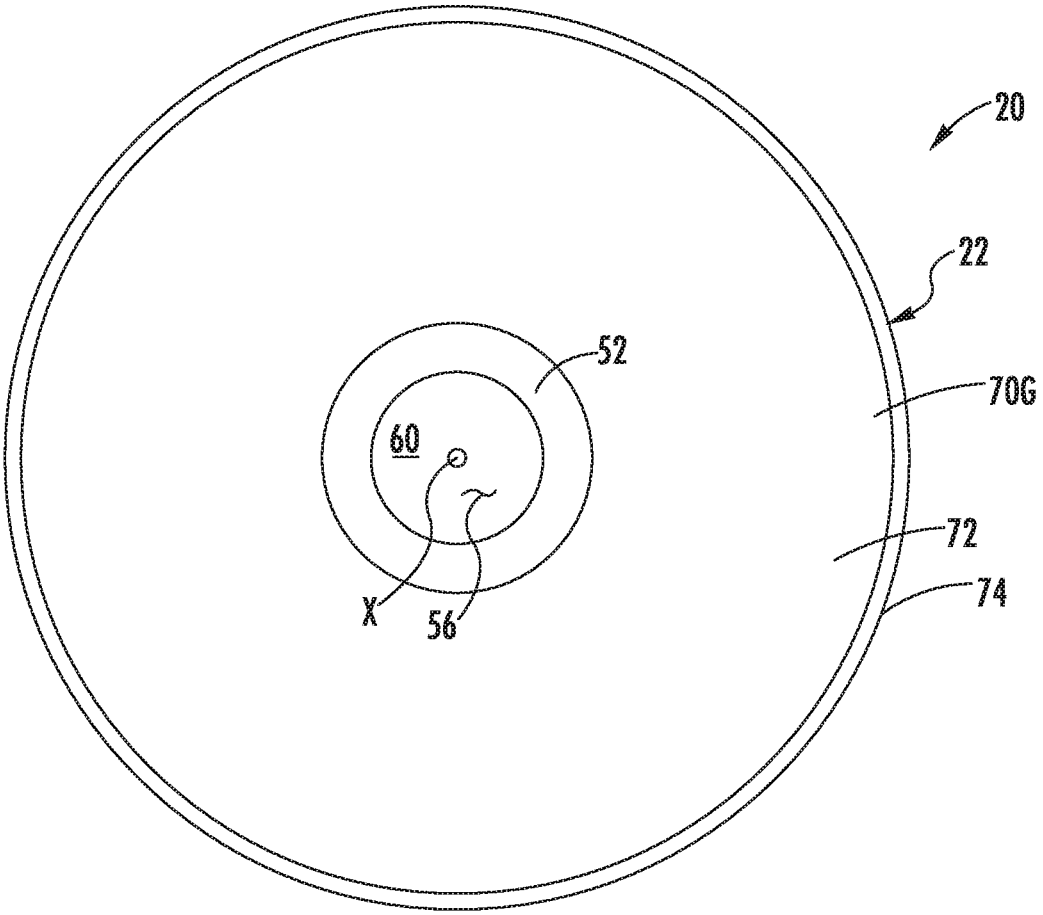
FIG. 4 is a bottom plan view of the embodiment of FIG. 1.
Figure 5:
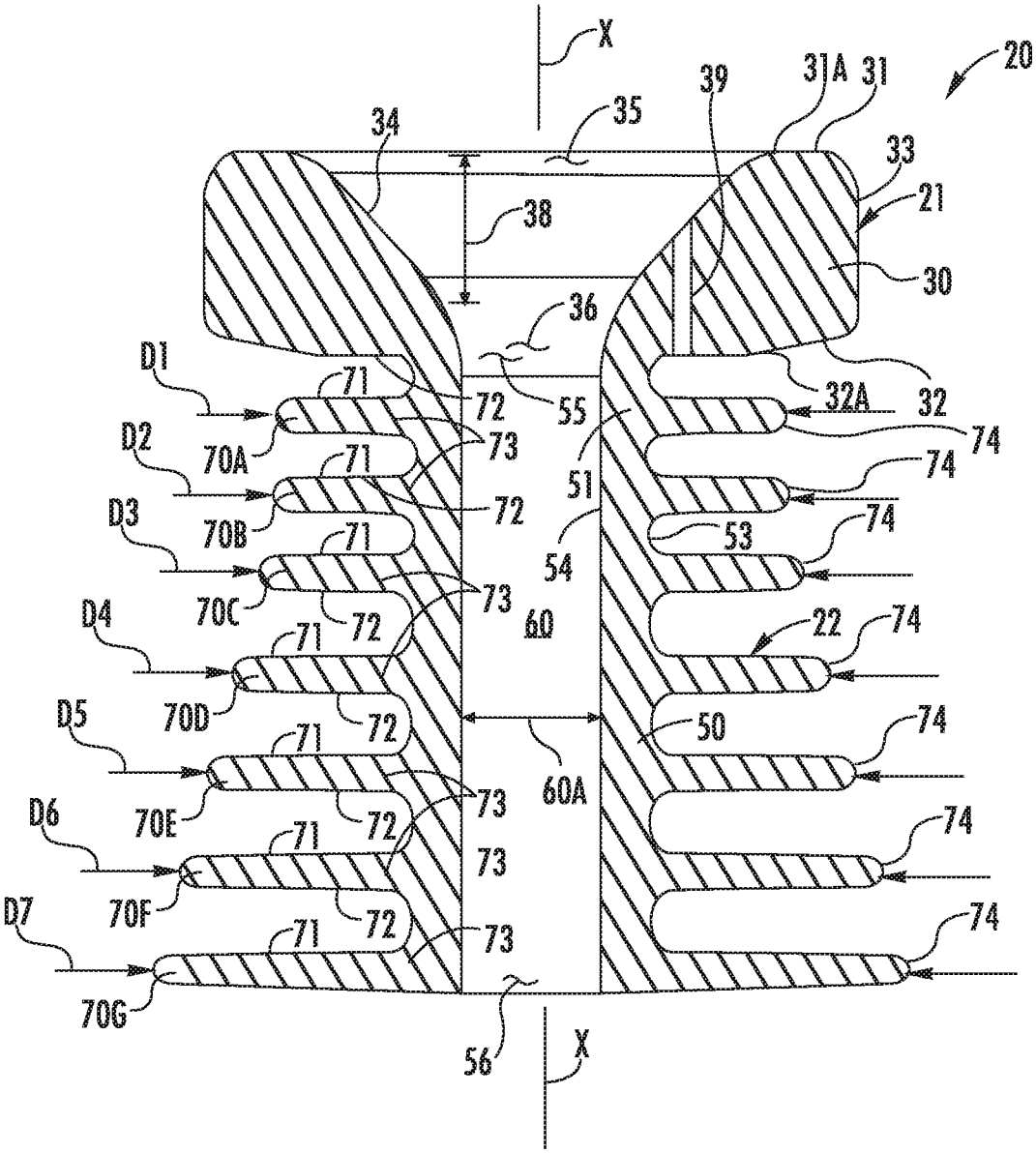
FIG. 5 is a section view taken along line 5-5 of FIG. 3.
Figure 6:
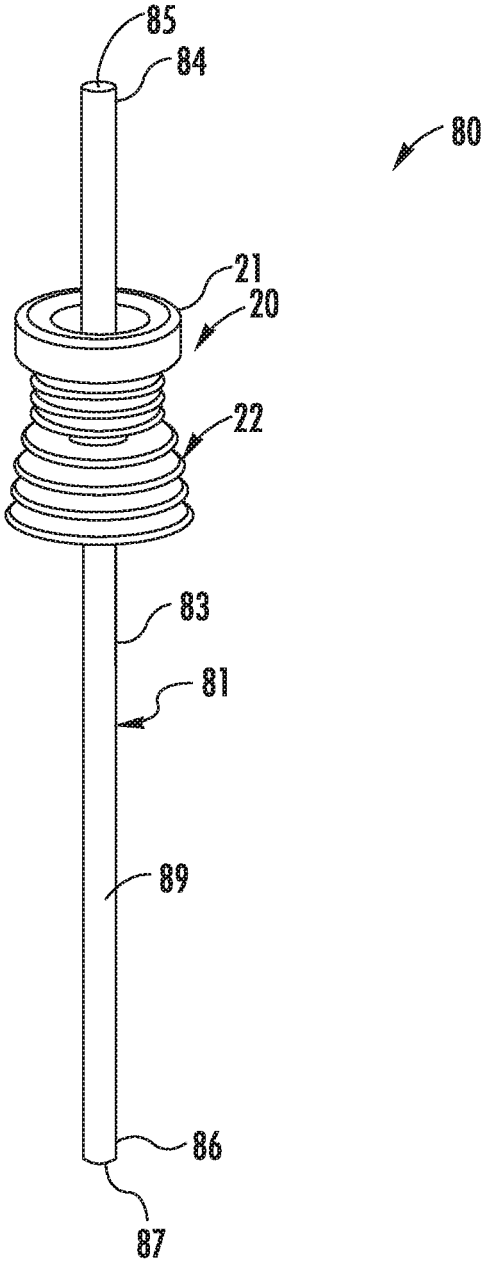
FIG. 6 is a perspective view of the stopper of FIGS. 1-5 shown installed onto a fluid tube forming a stopper and fluid tube assembly.
Figure 7:
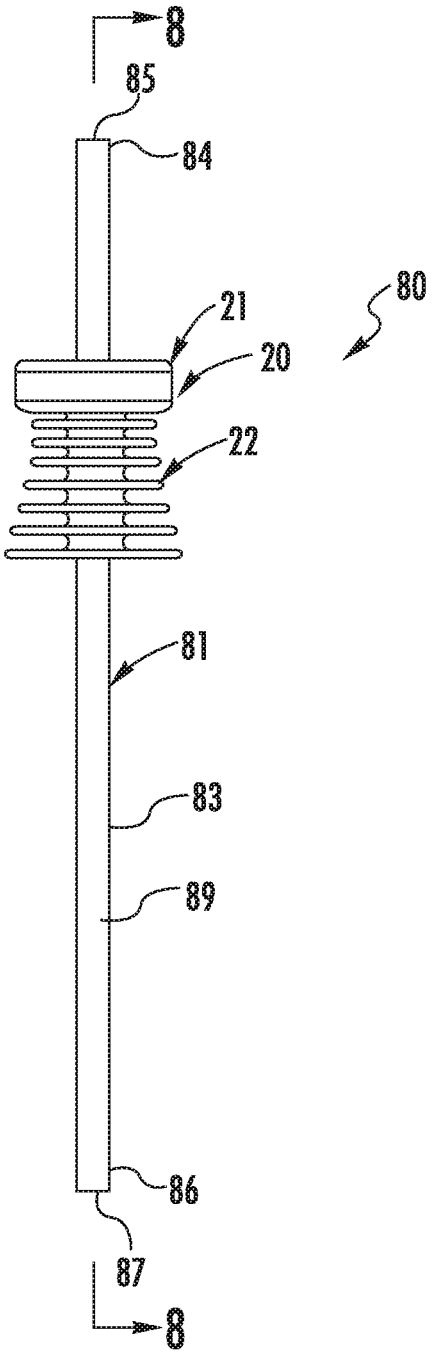
FIG. 7 is a side elevation view of the embodiment of FIG. 6.
Figure 8:
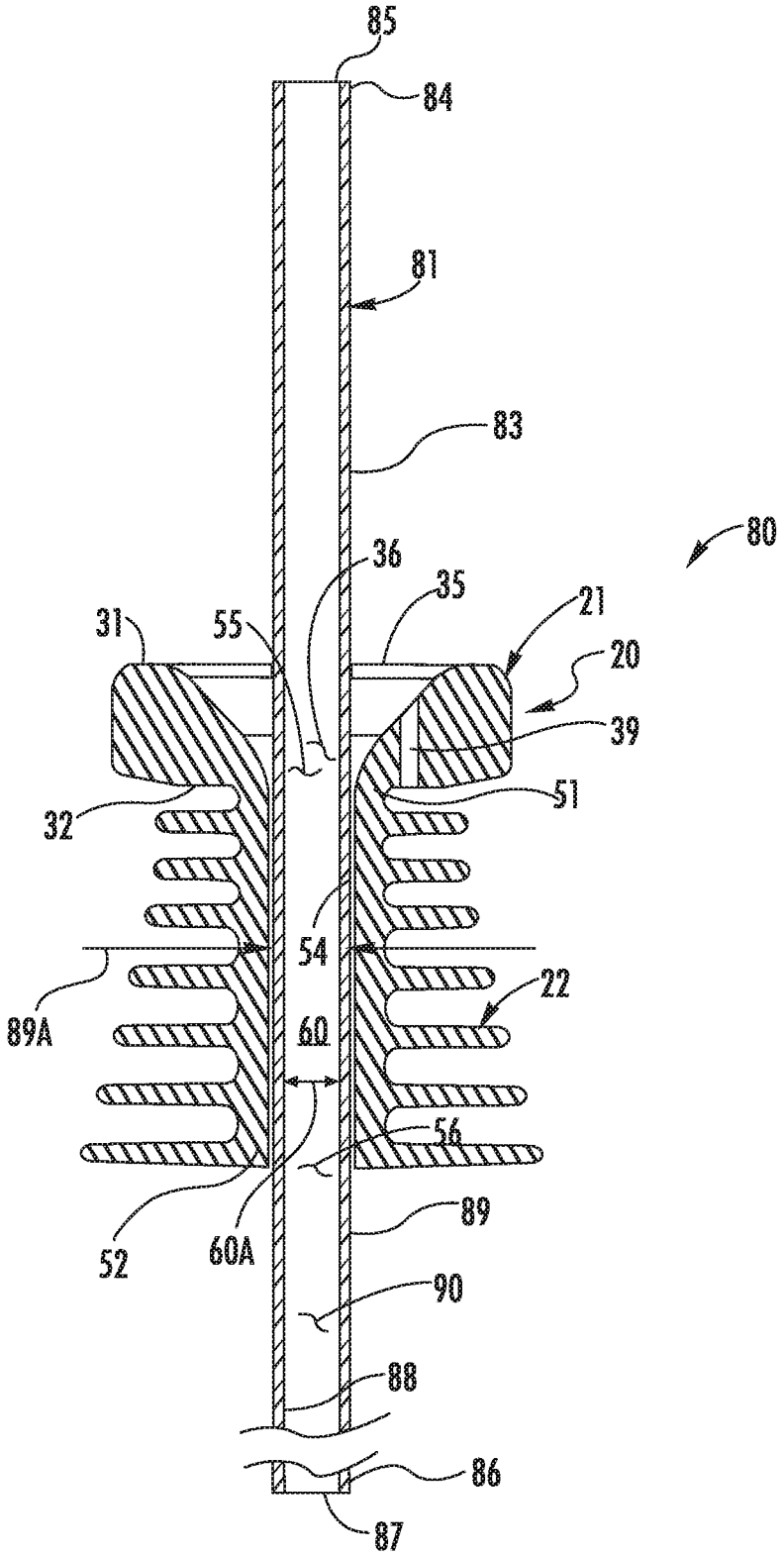
FIG. 8 is an enlarged fragmentary section view corresponding to FIG. 7 showing the installation of the stopper onto the fluid tube in greater detail.
Figure 9:
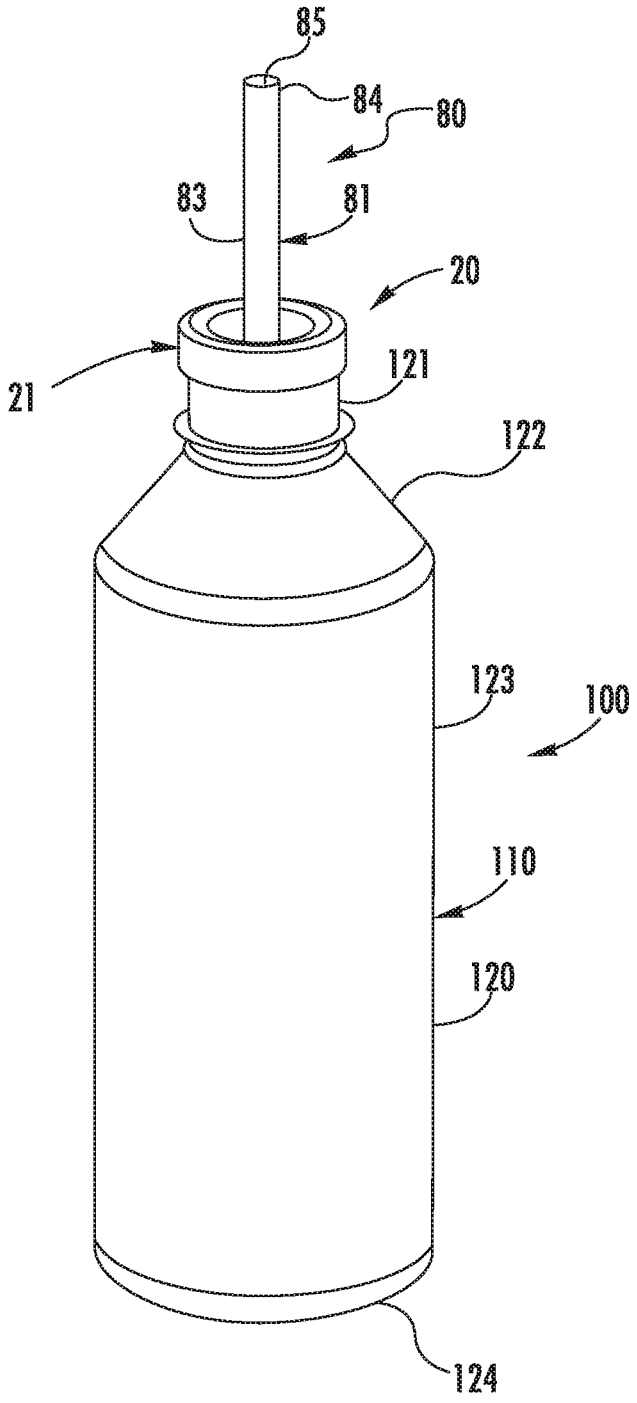
FIG. 9 is a perspective view of the embodiment of FIG. 6 shown as it would appear assembled with a container forming a container assembly.
Figure 10:
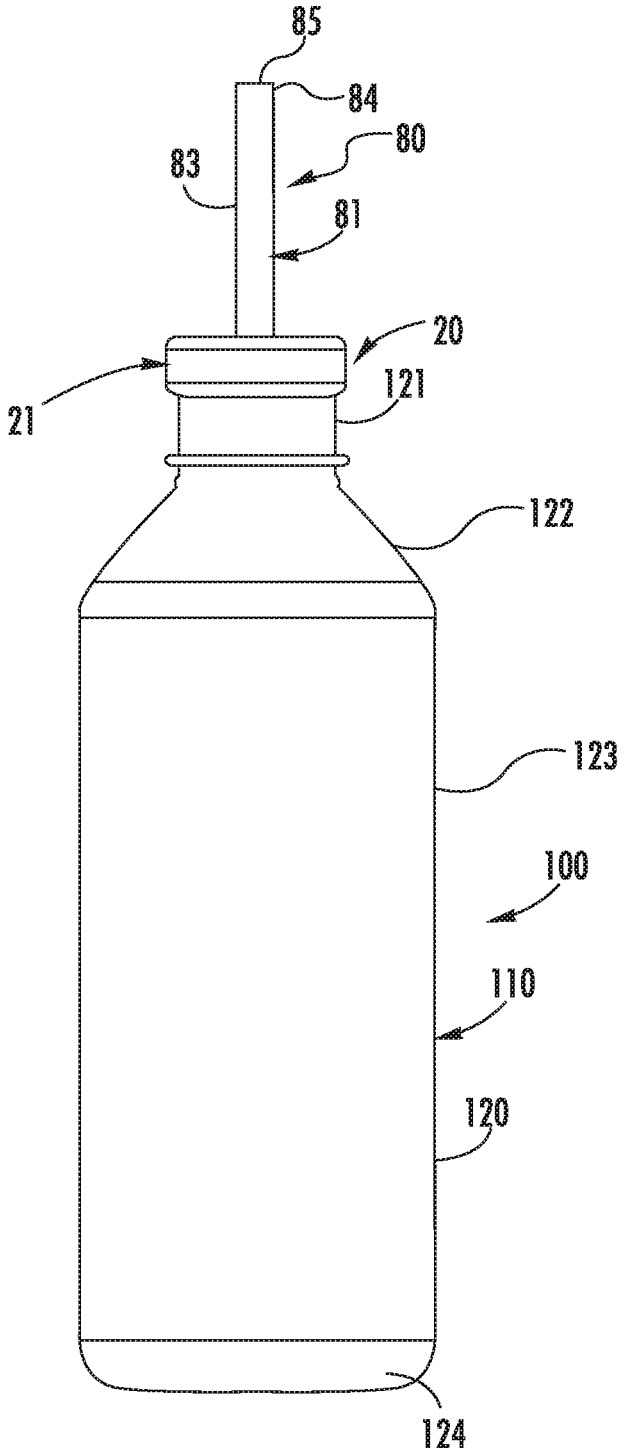
FIG. 10 is a side elevation view of the embodiment of FIG. 9.

Turning now to the drawings, in which like reference characters indicate corresponding elements throughout the several views, FIG. 1-5 illustrate a stopper 20, FIGS. FIGS. 6-8 illustrate a stopper and fluid tube assembly 80, and FIGS. 9 and 10 illustrate a container assembly 100 for holding and dispensing a fluid incorporating container 110 and stopper and fluid tube assembly 80.

§ A. The Stopper

Figure 1:
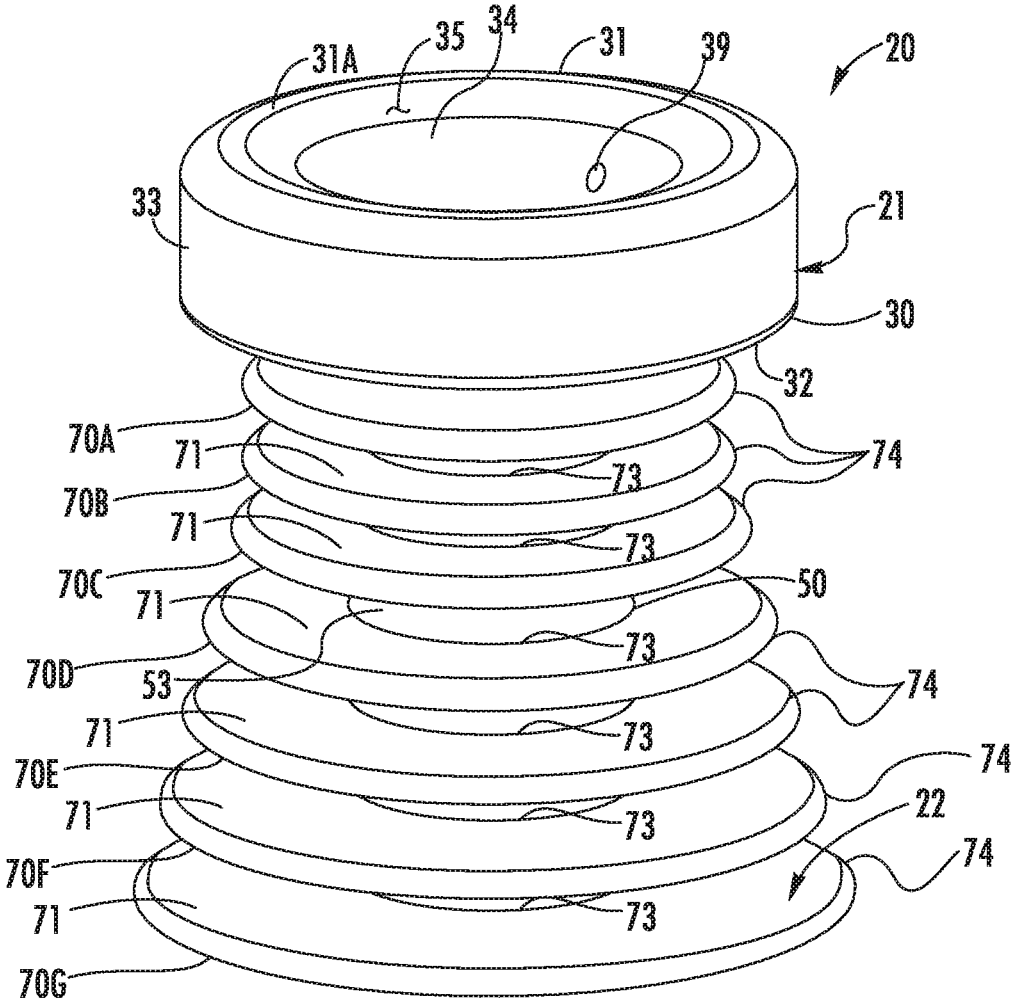
FIG. 1 is a perspective view of a stopper constructed and arranged in accordance with the principle of the invention.
Figure 2:
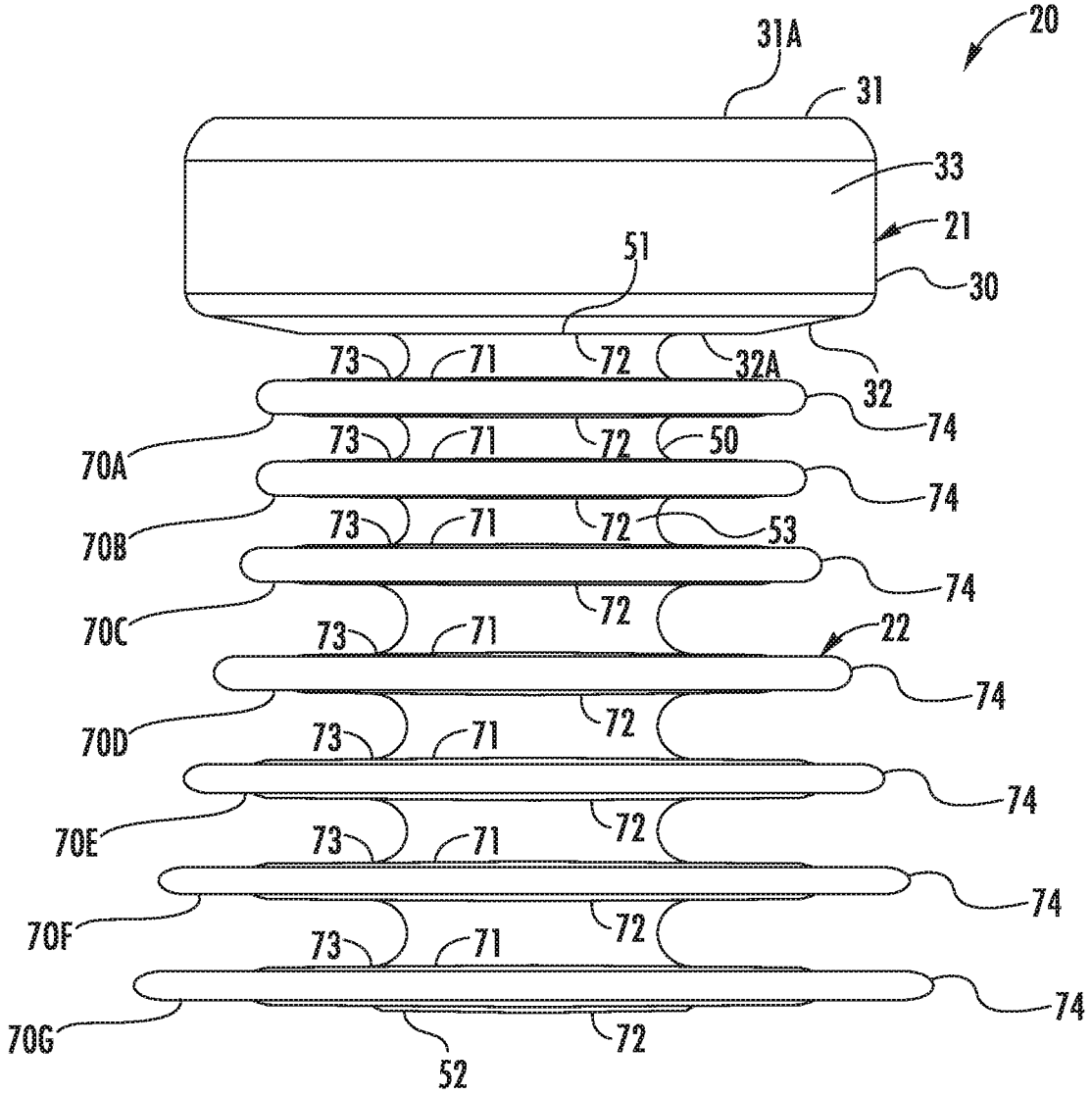
FIG. 2 is a side elevation view of the embodiment of FIG. 1.
Figure 3:
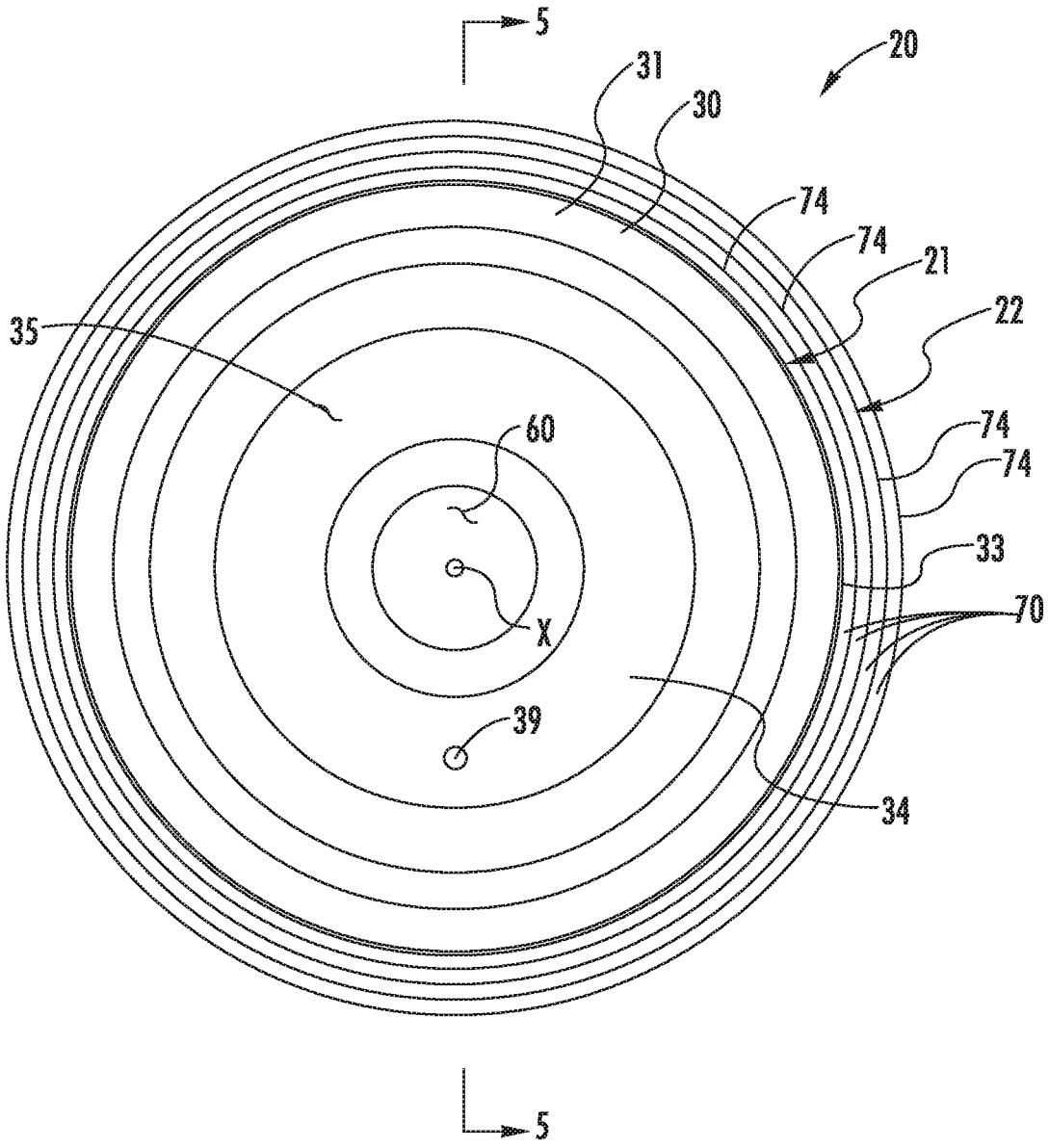
FIG. 3 is a top plan view of the embodiment of FIG. 1.

Referring to FIGS. 1-5 in relevant part, stopper 20 is formed of an elastomer, an elastic, resilient substance occurring naturally, as natural rubber, or produced synthetically, as butyl rubber or neoprene. Since stopper 20 is formed of an elastomer, stopper 20 is inherently resilient, and elastic, being capable of returning to its original shape after being deformed. Stopper 20 includes head part 21, and stopper part 23, which are arranged symmetrically about central axis X (FIGS. 3, 4, and 5). Axis X is the geometric center of stopper 20 about which head part 21 and stopper part 22 are arranged. Stopper 20 is useful for holding fluid tube 81 in FIGS. 6-8 and is useful for holding fluid tube 81 relative to container 110 in FIGS. 9-13, as described below.

Head part 21 is an annular member or body 30 that is hollow and that has upper end 31, lower end 32, outer surface 33, inner surface 34, upper opening 35, and lower opening 36. Outer surface 33 is continuous. Inner surface 34 is continuous. Inner surface 24 extends from lower opening 35 to upper opening 36, and upper and lower openings 35 and 36 are opposite to one another, are coaxial, and are parallel relative to each other. Upper opening 35 is larger than lower opening 36, and inner surface 34, which is continuous and conical, extends downwardly and inwardly from upper opening 35 proximate to upper end 31 to lower opening 36 proximate to lower end 32, in which inner surface 34 defines a frustum 38, a basal part of a cone that extends between parallel upper and lower planes inherently defined by parallel upper and lower openings 35 and 36 and that extends outwardly and upwardly from lower opening 36 proximate to lower end 32 to upper opening 35 proximate to upper end 31. Annular body 30 of head part 21, including outer surface 33 of annular body 30 of head part 21 and inner surface 34 of annular body 30 of head part 21, extend downwardly from upper end 31 to lower end 32. Upper end 31 defines upper surface 31A of annular body 30 of head part 21, and lower end 32 defines lower surface 32A of annular body 30 of head part 21. Upper surface 31A is continuous and is a radial surface that extends from upper opening 35 to outer surface 33. Lower surface 32A is continuous and is a radial surface that extends from stopper part 34 proximate to lower opening 36 to outer surface 33. Annular body 30 of head part 21 further includes breather hole 39. Breather hole 39 extends through annular body 30 of head part 22 from inner surface 34, between upper end 31 and lower end 32 and, more specifically, between upper opening 35 and lower opening 36, to lower surface 32A of lower end 32 between outer surface 33 and lower opening 36.

Stopper part 22 includes a stem 50 formed with sealing members being flanges 70. Stem 50 is elongate and hollow and has upper end 51, lower end 52, outer surface 53, inner surface 54, upper opening 55, and lower opening 56. Upper opening 55 and lower opening are coaxial and parallel relative to one another. Stem 50 of stopper part 22, including outer surface 53 and inner surface 54, extend downwardly from upper end 51 of stem 50 of stopper part 22 connected to lower end 32 of annular body 30 of head part 21 to lower end 52 of stem 50 of stopper part 22. Upper end 51 of stem 50 is integral with lower end 32 of annular body 30. Upper opening 55 is open to, and coaxial relative to, lower opening 36. Inner surface 34 of annular body 30 of head part 21 from upper opening 35 to lower opening 36 and inner surface 54 of stem 50 of stopper part 22 from upper opening 55 at upper end 51 of stem 50 of stopper part 22 to lower opening 56 at lower end 52 of stem 50 of stopper part 22 define channel 60 through stopper 20. Channel 60, a fluid tube-receiving channel, extends upright from lower opening 56 of stem 50 of stopper part to upper opening 35 of annular body 30 of head part 21.

Axis X about which head part 21 and stopper part 22 are symmetrically arranged, and which defines the geometric center of stopper part 22, extends through channel 60 from upper opening 35 of upper end 21 of head part 21 to lower opening 56 of lower end 52 of stem 50 of stopper part. Openings 35, 36, 55, 56, and channel 60 are arranged symmetrically about axis X.

Inner surface 54 of stem 50 of stopper part 22 that defines the stopper part of channel 60 defines inner diameter 60A of channel through stem 50, which is cylindrical and constant from proximate to lower opening 56 of lower end 52 to proximate to upper opening 55 of upper end 51. Frustum 38 of annular body 30 of head part 21 that extends from upper opening 35 to lower opening 36 defines the head part of channel 60 from upper opening 35 to comparatively smaller lower opening 36. The head part of channel 60 defined by frustum 38 is wide and frustoconical in relation to the comparatively narrow length of the stem part of channel 60 through stem 50.

Each flange 70 is an annular or circular body that has upper radial surface 71, lower radial surface 72, an inner end 73 connected to outer surface 53 of stem 50, and an opposed outer periphery 74 that defines outer diameter D. Outer periphery 74 defines an annular contact or sealing surface of flange 70. Inner end 73 is integral with outer surface 53 of stem 50. Each flange 70 radiates outwardly from inner end 73 connected to outer surface 53 of stem 50, to outer periphery 74. Flanges 70 are parallel relative to one another at rest, and are spaced apart, preferably equally spaced apart, along the length of stem 50 from proximate to upper end 51 of stem 50 to proximate to lower end 52 of stem 50. The outer diameters D of flanges 70 are different from one another, and increase, gradually, from an innermost one of flanges 70, innermost flange 70A, proximate to upper end 51 of stem 50 of stopper part 22 closest to lower end 32 of annular body 30 of head part 21, to an outermost one of flanges 70, flange 70G, proximate to lower end 52 of stem 50 of stopper part 22. There are seven flanges 70A-70G in this embodiment that define seven different outer diameters D1-D7, and less or more flanges can be used in alternate embodiments. Flanges 70A-70B extend in sequence along stem 50 from innermost flange 70A proximate to upper end 51 and having diameter D1, to outermost flange 70G proximate to lower end 52 and having outer diameter D7. Outer diameters D1-D7 are different from one another and increase, gradually, from flange 70A proximate to upper end 51 to flange 70G proximate to lower end 52.

§ B. The Stopper and Fluid Tube Assembly

FIGS. 6-8 illustrate stopper 20 installed onto a fluid tube 81 forming a stopper and fluid tube assembly denoted at 80. Referring to FIGS. 6-8 in relevant part, fluid tube 81 is elongate, cylindrical, is shaped like an ordinary drinking straw, and defines a fluid flow/transfer path 90 therethrough. Fluid tube 81 is fashioned of plastic in this example, and, in this example, is approximately 8 inches long with a 0.25-inch interior diameter. Those having regard for the art will readily appreciate that the dimensions and materials of fluid tube 81 can vary.

Fluid tube 81 consists of an upstanding continuous sidewall 83 having a proximal end 84 forming an outlet 85, and an opposing distal end 86 forming an inlet 87. Proximal end 84 is the outlet end of fluid tube 81 from which fluid is withdrawn, and distal end 86 is the inlet end of fluid tube 81. Outlet 85 and inlet 87 allow liquids/fluids to be drawn through fluid tube 81 from distal end 86 to proximal end 85. Fluid tube 81 has inner surface 88 and outer surface 89 that extend from proximal end 84 to distal end 86. Inner surface 88 defines fluid transfer path 90 from outlet 85 to inlet 87. Outer surface 89 defines outer diameter 89A of fluid tube 81, which is constant from proximal end 84 to distal end 86. Outer diameter 89A of fluid tube 81 corresponds to inner diameter 60A of channel 60 of stem 50 of stopper part 22.

In assembly 80, the stopper and fluid tube assembly, stopper 20 is applied to fluid tube 81, between proximal end 84 and distal end 86, and stopper 20 extends upright along fluid tube 81 from lower end 52 of stopper part 22 directed toward distal end 86 to upper end 31 of head part 21 directed toward proximal end 84. Fluid tube 81 extends upright from distal end 86 to proximal end 84 through channel 60 of stopper 20. Inner surface 54 of stopper part 22 between head part 21 and lower end 52 of stopper part 22 frictionally engages outer surface 89 of fluid tube 81 between lower end 52 of stopper part 22 and head part 21 frictionally retaining and sealing fluid tube 81 to stopper 20, and fluid tube 81 enables fluid contents to be withdrawn from the volume of a container via fluid transfer path 90 from inlet 87 of fluid tube 81 to outlet 85 of fluid tube 81 while the same time the sealing engagement between outer surface 89 of fluid tube 81 and inner surface 54 of stopper part 22 disables fluid from migrating/leaking between outer surface 89 of fluid tube 81 and inner surface 54 of stopper part 22. Fluid tube 81 is inserted into and through channel 60 and extends upright from inlet 87 of distal end 86 to and through lower opening 56 of stopper part 22 and upwardly through channel 60 from lower opening 56, concurrently through upper opening 55 of stopper part 22 and lower opening 36 of head part 21 and through upper opening 35 of head part 21 and upwardly and outwardly from upper opening 35 of head part 21 to outlet 85 of proximal end 84. Outer diameter 89A of fluid tube 81 corresponds to inner diameter 60A of channel 60 of stem 50 of stopper part 22, in which inner surface 54 of stem 50 of stopper part 22 between lower end 52 of stem 50 and both upper end 51 of stem and head part 21 frictionally engages outer surface 89 of fluid tube 81 frictionally retaining or otherwise holding and also sealing fluid tube 81 to stopper 20. The inherent elasticity of stopper 20 enables stopper 20 to yield when it is installed onto fluid tube 81, and enables inner surface 54 to frictionally engage outer surface 89 to frictionally retain or otherwise hold fluid tube 81 to stopper 20 as described above. In assembly 80, frustum 38 extends outwardly and upwardly from outer surface 89 of fluid tube 81 at lower opening 36 proximate to lower end 32 of head part 21 to upper opening 35 of head part 21 at upper end 31 of head part 21.

Fluid tube 81 can be inserted proximal end 84 first into and through channel 60 through lower opening 56 of stopper part 22 and slid upwardly through channel 60 to locate stopper 20 at a selected position along the length of fluid tube 81, such as between proximal end 84 and distal end 86. Alternatively, fluid tube 81 can be inserted distal end 86 first into and through channel 60 through upper opening 35 of head part 21 slid downwardly through channel 60 to locate stopper 20 at a selected position along the length of fluid tube 81, such as between proximal end 84 and distal end 86. Fluid tube assembly 80 is useful with container 110 described below.

§ C. The Container Assembly for Holding and Dispensing a Fluid

Figure 13:
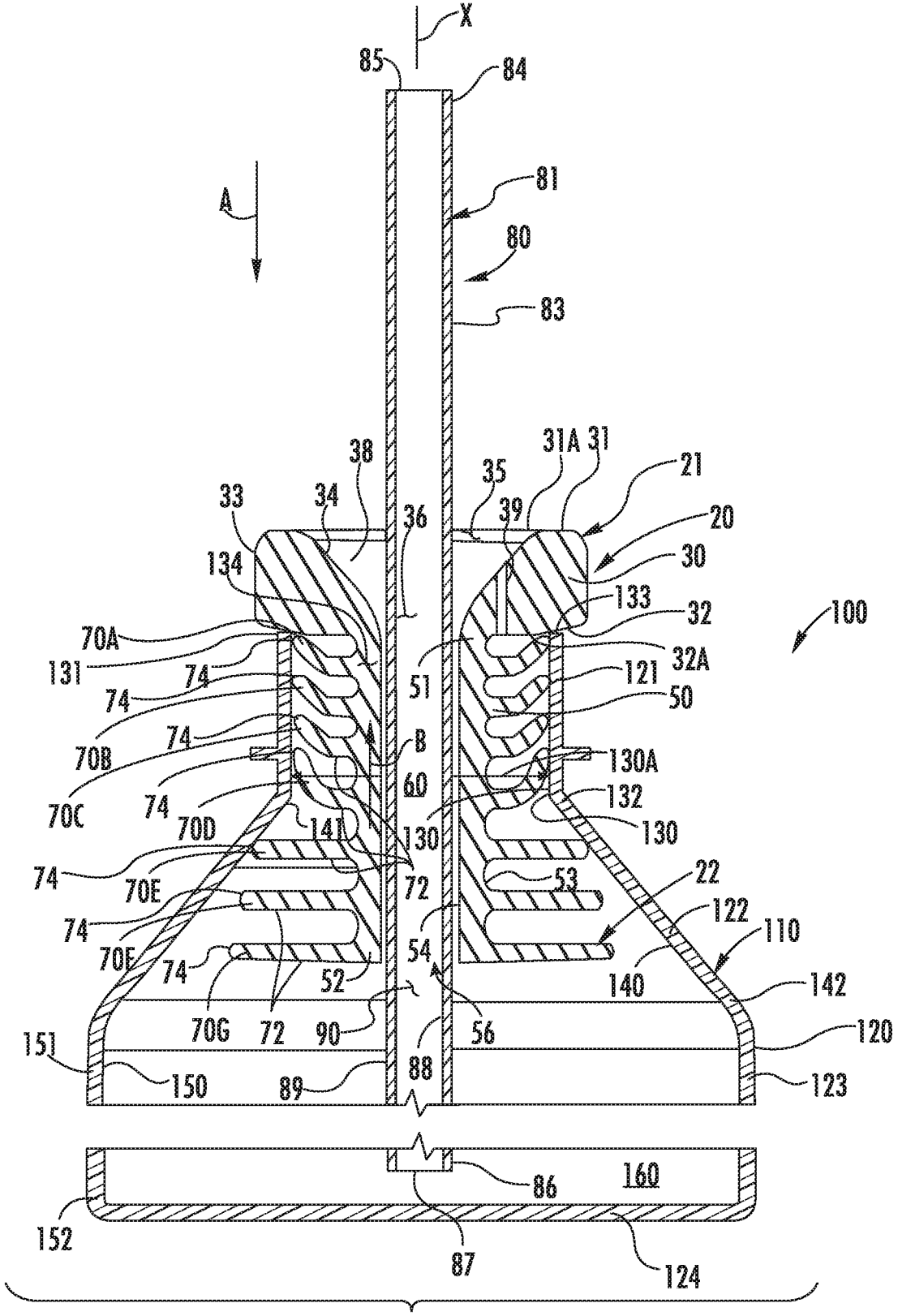

FIGS. 9, 10, and 13, illustrate stopper and fluid tube assembly 80 assembled with a container 110 to form a container assembly 100. Container 110 is a standard bottle useful for holding fluid, is fashioned customarily of plastic, metal, glass, or other fluid impervious material or combination of materials. As with standard bottles, container 110 is formed integrally and is a body 120 that includes neck 121, shoulder 122, sidewall 123, and bottom 124.

Referring to FIGS. 9-13 in relevant part, neck 121 is continuous and includes neck inner surface 130, upper end 131, and lower end 132. Upper end 131 has a lip or rim 133 that defines mouth 134 to the interior volume of body 120 of container 110. Neck 121, including neck inner surface 130, extends downwardly from lip 133 of upper end 131 to lower end 132. Neck inner surface 130 defines inner diameter 130A of neck 121, which in this example is constant from mouth 134 to lower end 132. The length of stem 50 of stopper part 22 from upper end 51 to lower end 52 is greater than the length of neck 121 from lip 133 and mouth 134 to lower end 132.

Shoulder 122 is continuous and includes shoulder inner surface 140, upper end 141 connected to lower end 132 of neck 121, and lower end 142. Shoulder 122, including shoulder inner surface 140, which is frustoconical, extends downwardly and outwardly from upper end 141 of shoulder 122 to lower end 142 of shoulder 122.

Sidewall 123 is continuous and includes sidewall inner surface 150, upper end 151 connected to lower end 142 of shoulder 122, and lower end 152. Sidewall 123, including sidewall inner surface 150, extends downwardly from upper end 151 of sidewall 123 to lower end 152 of sidewall 123.

Bottom 124 is connected to lower end 152 of sidewall 123. Bottom 124 cooperates with neck inner surface 130, shoulder inner surface 140, and sidewall inner surface 150 to form volume 160 of body 120 of container 110 for receiving a fluid placed in volume 160 through mouth 134 and for withdrawing fluid placed in volume 160 from mouth 134.

Figure 11:
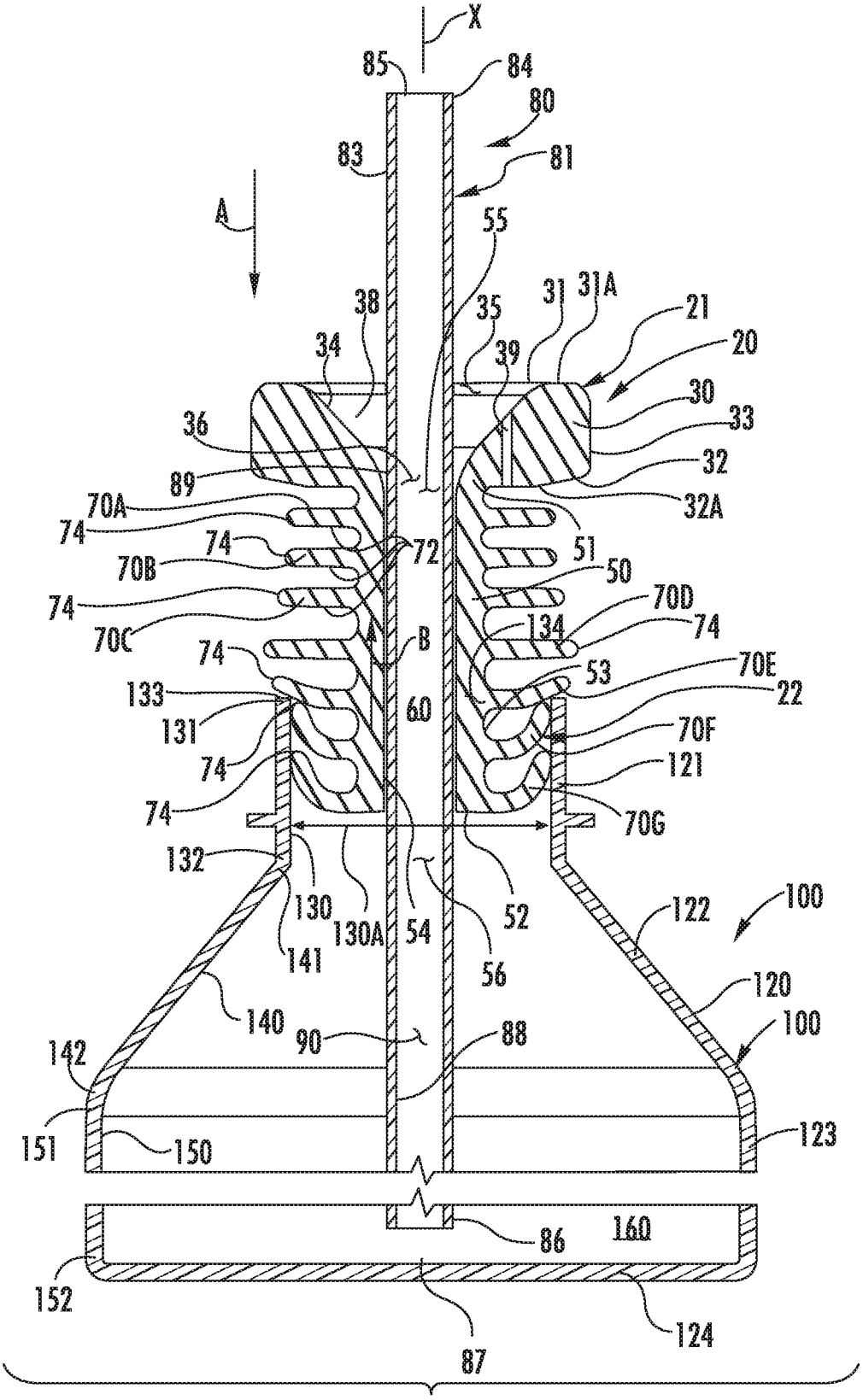
FIGS. 11-13 are enlarged, fragmentary section views corresponding to FIGS. 9 and 10 illustrating the installation of the stopper and fluid tube assembly with the container.
Figure 12:
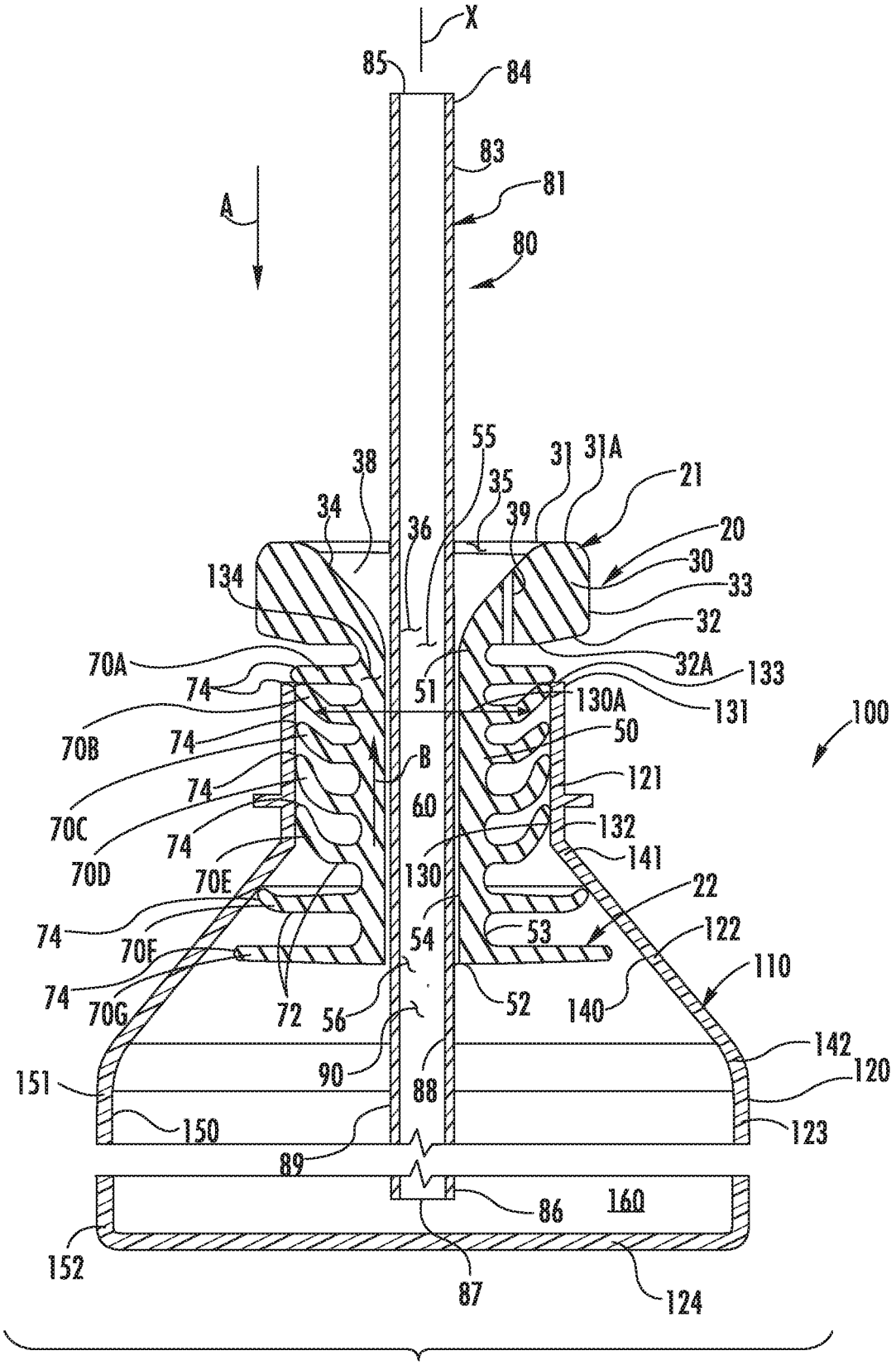

In the use of stopper and fluid tube assembly 80 with container 110 with reference in relevant part to FIGS. 11-13, distal end 86 of fluid tube 81 is inserted through mouth 134 and into container 110 volume 160 through neck 121 and past shoulder 122 and downwardly into the fluid contents in volume 160 of container 110 when fluid contents are in volume 160 having been previously applied to volume 160 through mouth 134. Stopper part 21 of stopper 20 is, in turn, inserted forcibly, such as by hand, lower end 52 first downwardly in the direction of arrowed line A in FIGS. 11-13 into volume 160 through mouth 134 into and through neck 121 until lower surface 32A of lower end 32 of head part 21, between outer surface 53 of stem 50 of stopper part 22 and outer surface 33 of head part 21, comes into direct sealing contact against lip 133 in FIG. 13, which arrests further downward movement of stopper 20 in the direction of arrowed line A. The inherent elastic material characteristic of stopper 20 enables lower surface 32A of lower end 32 of head part 21 to sealingly engage lip 133 of upper end 131 of neck 121.

In FIG. 13, which shows stopper 20 assembled with container 110 to form container assembly 100, the assembly of stopper and fluid tube assembly 80 and container 110, head part 21 is outside mouth 134 and extends outwardly/upwardly from lower surface 32A of lower end 32 of head part 21, juxtaposed to mouth 134, to upper end 31 of head part 21. Stopper part 22 in volume 160 extends downwardly through neck 121 into volume 160 from upper end 51 of stopper part 22 proximate to mouth 134 to lower end 52 of stopper part 22 beyond lower end 132 of neck 121 and upper end 141 of shoulder 122 in FIG. 13. The length of stem 50 of stopper part 22 from upper end 51 to lower end 52 being greater than the length of neck 121 from lip 133 and mouth 134 to lower end 132 enables lower end 52 to pass beyond lower end 132 of neck 121 and upper end 141 of shoulder 122 when stopper part 22 is fully inserted into volume 160 through mouth 134 in FIG. 13.

FIGS. 11 and 12 show stopper part 21 as it would appear being inserted lower end 52 first into volume 160 through mouth 134 of neck 121 and stopper 20, and also assembly 80, partially assembled with container 110, in which FIG. 11 shows stopper part 21 initially inserted lower end 52 first into volume 160 through mouth 134, FIG. 12 shows stopper part 21 more fully inserted lower end 52 first into volume 160 through mouth 134, and FIG. 13 shows stopper 20 fully inserted lower end 52 first into volume 160 through mouth. In FIG. 13, stopper 20, and also assembly 80, are assembled, meaning fully assembled, with container 110, in which stopper part 22 is inserted lower end 52 first through mouth 134 and through neck 121 into volume 160 when lower surface 32A of lower end 32 of head part 21 is lowered in the direction of arrowed line A into direct contact against lip 133 as described above. Head part 21 is sufficiently sized to enable lower surface 32A of lower end 32 of head part 21 to come into direct sealing contact against lip 133 between outer surface 33 of head part 21 and outer surface 53 of stem 50 of stopper part 22 when stopper 20 is assembled with container 110 in FIG. 13. When stopper 20 is assembled with container 110 in FIG. 13, breather hole 39 extends through head part 21, from inner surface 34 of head part 21, between upper end 31 of head part 21 and lower end 32 of head part 21, to lower surface 32A of lower end 32 of head part 21 and is open at lower end 32 of head part 21 to volume 160 at mouth 134 neck inner surface 130 and outer surface 53 of stopper part 21 enabling breather hole to regulate pressure between volume 160 and an external environment.

Diameters D of flanges 70 are greater than diameter 130A of neck 121 from mouth 134 to lower end 132 of neck 121. When stopper part 22 is forcibly inserted lower end 52 first into volume 160 through mouth 134 in the direction of arrowed line A in FIGS. 11-13, the inherent elastic material characteristic of stopper 20, and thus of flanges 70, enables flanges 70 to flex or otherwise deform/deflect upwardly in the direction of arrowed line B in FIGS. 11-13 when outer peripheries 74 and lower radial surfaces 72 encounter lip 133 and slide downwardly along neck inner surface 130 in the direction of arrowed line A. When flanges 70F and 70G proximate to lower end 52 clear lower end 132 of neck 121 and upper end 141 of shoulder 122 in FIG. 12 and when flange 70E proximate to lower end 52 clears lower end 132 of neck 121 and upper end 141 of shoulder 122 in FIG. 13 when lower end 52 of stopper 20 advances into volume 160 beyond lower end 132 of neck 121 and upper end 141 of shoulder 122, flanges 70G, 70F, and 70E, sequentially resume their original shapes as a result of their inherent elastic material characteristics.

In FIG. 13, flanges 70A-70D are proximate to neck 121 and to neck inner surface 130 between upper end 131 and lower end 132 of neck 121, and flanges 70E-70G are proximate to shoulder 122 and to shoulder inner surface 140 below lower end 132 of neck 121 and upper end 141 of shoulder 122 when stopper part 22 is fully inserted into volume 160 through mouth. Flange 70G, the lowermost one of flanges 70 of stopper 20 proximate to lower end 52, radiates outwardly from outer surface 53 of stem 50 to outer periphery 74 of flange 70G toward and spaced-apart inwardly from shoulder inner surface 140, flange 70F immediately above flange 70G proximate to lower end 52 radiates outwardly from outer surface 53 of stem 50 to outer periphery 74 of flange 70F toward and spaced-apart inwardly from shoulder inner surface 140, and flange 70E immediately above flange 70F proximate to lower end 52 radiates outwardly from outer surface 53 of stem 50 to outer periphery 74 toward and in direct sealing contact against shoulder inner surface 140 between upper end 141 of shoulder 122 and lower end 142 of shoulder 122, in which outer periphery 74 of flange 70E is engaged sealingly to shoulder inner surface 140 of shoulder 122 between upper end 141 of shoulder 122 and lower end 142 of shoulder. In FIG. 13, the diameter D7 of flange 70G is insufficient to enable outer periphery 74 of flange 70G to reach and make sealing contact against shoulder inner surface 140 between upper end 141 of shoulder 122 and lower end 142 of shoulder 122, the diameter D6 of flange 70F is insufficient to enable outer periphery 74 of flange 70F to reach and make sealing contact against shoulder inner surface 140 between upper end 141 of shoulder 122 and lower end 142 of shoulder 122, and the diameter D5 of flange 70E is sufficient to enable outer periphery 74 of flange 70E to reach and make sealing contact against shoulder inner surface 140 between upper end 141 of shoulder 122 and lower end 142 of shoulder 122. Flange 70E acts as mechanical gasket that is compressed between outer surface 53 of stem 50 and shoulder inner surface 140, creating a seal between stopper part 22 and shoulder inner surface 140, and any flange 70 of stopper part 22 that seals against the shoulder inner surface of a container acts identically to flange 70E as a mechanical gasket.

In FIG. 13, at least one flange, flange 70E, proximate to lower end 52 of stopper part 22, extends outwardly from outer surface 53 of stem 53 of stopper part 22 to its outer periphery 74 engaged sealingly directly to shoulder inner surface 140 between upper end 141 of shoulder 122 and lower end 142 of shoulder 122. Depending on the diameters of flanges 70 proximate to lower end 52 and the distance from outer peripheries 74 of flanges 70 proximate to lower end 52 and shoulder inner surface 140, the outer peripheries 74 of two or more of flanges 70 proximate to lower end 52 of stopper part 22, or opposing shoulder inner surface 140, such as the outer peripheries 74 of two or more of flanges 70G, 70F, and 70E, can reach and directly sealing engage shoulder inner surface 140 between upper end 141 of shoulder 122 and lower end 142 of shoulder 122 when stopper part 22 is fully inserted into volume 160 through mouth 134. For the purposes of definition and orientation, the one or more of flanges 70 that sealingly engage neck inner surface 130 are considered to be upper or proximal flanges 70 or otherwise proximate to upper end 51, whereas one or more of flanges 70 that sealingly engage shoulder inner surface 140 are considered to be lower or distal flanges or otherwise proximate to lower end 52. The different diameters of the flanges 70 proximate to lower end 52, flanges 70E-70G in this example, enable stopper part 22 to seal to the shoulder inner surfaces of differently sized container shoulders.

In FIG. 13, flanges 70A-70D are proximate to neck 121 and to neck inner surface 130 when stopper part 22 is fully inserted into volume 160 through mouth, in which flange 70A, the uppermost one of flange 70A proximate to upper end 51, radiates outwardly and upwardly, being upwardly flexed in the direction of arrowed line B, from outer surface 53 of stem 50 to outer periphery 74 of flange 70A toward and in direct sealing contact against neck inner surface 130 between upper end 131 and mouth 134 of neck 131 and lower end 132 of neck 121, flange 70B immediately below flange 70A proximate to upper end 51 radiates outwardly and upwardly, being upwardly flexed in the direction of arrowed line B, from outer surface 53 of stem 50 to outer periphery 74 of flange 70B toward and in direct sealing contact against neck inner surface 130 between upper end 131 and mouth 134 of neck 131 and lower end 132 of neck 121, flange 70C immediately below flange 70B proximate to upper end 51 radiates outwardly and upwardly, being upwardly flexed in the direction of arrowed line B, from outer surface 53 of stem 50 to outer periphery 74 of flange 70C toward and in direct sealing contact against neck inner surface 130 between upper end 131 and mouth 134 of neck 131 and lower end 132 of neck 121, and flange 70D, and intermediate one of flanges 70 proximate to upper end 51 and which is immediately below flange 70C between upper and lower ends 51 and 52 radiates outwardly and upwardly, being upwardly flexed in the direction of arrowed line B, from outer surface 53 of stem 50 to outer periphery 74 of flange 70D toward and in direct sealing contact against neck inner surface 130 between upper end 131 and mouth 134 of neck 131 and lower end 132 of neck 121. Flanges 70A-70D each act as a mechanical gasket that is compressed between outer surface 53 of stem 50 and neck inner surface 130, creating a seal between stopper part 22 and neck inner surface 130, and any flange 70 of stopper part 22 that seals against a neck inner surface of a container acts as a mechanical gasket as described.

In FIG. 13, the diameters D1-D4 of flange 70A-70D, respectively, are each sufficient to enable the respective outer peripheries 74 of flange 70A-70D to reach and make sealing contact against neck inner surface 130 surface 130 between upper end 131 and mouth 134 of neck 121 and lower end 132 of neck 131. In FIG. 13, each of flanges 70A-70D extends outwardly from outer surface 53 of stem 53 of stopper part 22 to its outer periphery 74 engaged sealingly directly to neck inner surface 130 between upper end 131 and mouth 134 of neck 121 and lower end 132 of neck 121. Depending on the diameters of flanges 70A-70D, the distance from outer peripheries 74 of flanges 70A-70D and neck inner surface 130, and the length of stopper part 22 relative to the length of neck 121, the outer peripheries 74 of less than all of flanges 70A-70D and at least one of flanges 70A-70D can reach and directly sealing engage neck inner surface 130 between upper end 131 and mouth 134 of neck 121 and lower end 132 of neck 121 when stopper part 22 is fully inserted into volume 160 through mouth 134. For instance, when diameter 130A of neck 130 is less than diameter D4 of flange 70D but greater than diameters D1-D3 of the respective flanges 70A-70C, then only outer periphery 74 of flange 70D will sealingly engage neck inner surface 130. When diameter 130A of neck 130 is less than diameter D3 of flange 70C but greater than diameters D1-D2 of the respective flanges 70A-70B, then only outer peripheries 74 of flanges 70D and 70C will sealingly engage neck inner surface 130. When diameter 130A of neck 130 is less than diameter D2 of flange 70B but greater than diameter D1 of flange 70A, then only outer peripheries 74 of flanges 70D, 70C, and 70C will sealingly engage neck inner surface 130.

The flanges 70 that sealingly engage the neck and shoulder inner surfaces 130 and 140 hold and fluid seal stopper 20 in place to container 110. The sealing engagement of stopper part 22 to shoulder inner surface 140, via flange 70E in this example, the sealing engagement of stopper part 22 to neck inner surface 130, via flanges 70A-70D in this example, and the sealing engagement of lower surface 32A of lower end 32 of head part 21 against lip 133 of upper end 131 of neck 121 fluid seals stopper 20 to container 110 at shoulder inner surface 140, neck inner surface 130, and mouth 134 for disabling fluid in volume 120 from leaking from volume 160 and past the sealingly engaged flanges 70 and past the sealingly engaged head part 21 and outwardly through mouth 134. Again, depending on the diameters of flanges 70 proximate to lower end 52, flanges 70E-70G in this example, the lower or shoulder-engaging flanges of stopper 20, and the distance from outer peripheries 74 of flanges 70 proximate to lower end 52 and shoulder inner surface 140, the outer peripheries 74 of two or more of flanges 70E-70G proximate to lower end 52 of stopper part 22 can reach and directly sealing engage shoulder inner surface 140 between upper end 141 of shoulder 122 and lower end 142 of shoulder 122 to restrict fluid leakage when stopper part 22 is fully inserted into volume 160 through mouth 134. Furthermore, depending on the diameters of flanges 70A-70D proximate to upper end 51, the upper or neck-engaging flanges of stopper 20, inner diameter 130A of neck 121, and the respective lengths of neck 121 and stopper part 22, the outer peripheries 74 of all of flanges 70A-70D can reach and directly sealing engage neck inner surface 130 between upper end 131 and mouth 134 of neck 121 and lower end 132 of neck 121 to restrict fluid leakage when stopper part 22 is fully inserted into volume 160 through mouth 134, only outer periphery 74 of flange 70D can reach and directly sealing engage neck inner surface 130 between upper end 131 and mouth 134 of neck 121 and lower end 132 of neck 121 to restrict fluid leakage when stopper part 22 is fully inserted into volume 160 through mouth 134, only outer peripheries 74 of flanges 70C and 70D can reach and directly sealing engage neck inner surface 130 between upper end 131 and mouth 134 of neck 121 and lower end 132 of neck 121 to restrict fluid leakage when stopper part 22 is fully inserted into volume 160 through mouth 134, and only outer peripheries 74 of flanges 70B-70D can reach and directly sealing engage neck inner surface 130 between upper end 131 and mouth 134 of neck 121 and lower end 132 of neck 121 to restrict fluid leakage when stopper part 22 is fully inserted into volume 160 through mouth 134. Accordingly, stopper 20 is so structured to enable it to be used with containers having necks and shoulders of varying dimensions, according to the principle of the invention.

In container assembly 100 in FIG. 13, fluid tube 81 is held by stopper 20 which, in turn, is held by container 110. Fluid tube 81 extends upright through volume 160 from inlet 87 of distal end 86 in volume 160 proximate to bottom 124 to and through channel 60 of stopper 20 from lower opening 56 of stopper part 20 outwardly from volume 160 through mouth 134 to upper opening 35 of head part 21 and outwardly from upper opening 35 of head part 21 and container 110 to outlet 85 of proximal end 84 enabling outlet 85 to be coupled to a suction source, such as to the mouth of a user or a fluid dispensing mechanism, in which inner surface 54 of stopper part 22 between head part 21 and lower end 52 of stopper part 22 frictionally engages outer surface 89 of fluid tube 81 between lower end 52 of stopper part 22 and head part 21 frictionally retaining fluid tube 81 to stopper 20. At least one of flanges 70A-70D, and all of flanges 70A-70D in this example, seal and hold stopper part 22 to neck inner surface 130, at least one of flanges 70E-70F, flange 70E in this example, seal and hold stopper part 22 to shoulder inner surface 140, and lower surface 32A of lower end 32 of head part 21 remaining outside of container 110 seals head part 21 to upper end 131 of neck 121 sealing mouth 134. The fluid contents in volume 160 of container 110 may be withdrawn from proximate to bottom 124 of container 110 by sucking the fluid contents, such as by mouth or with a pump or the like, through transfer path 90 of fluid tube 81 from inlet 87 in volume 160 proximate to bottom 124 and outwardly through outlet 85, while at the same time air passes into volume 160 of container 110 through breather hole 39 from an external environment to volume 160 when the fluid contents in volume 160 are withdrawn from volume 160 via fluid tube 81 equalizing the pressure between the external environment and volume 160 for enabling the fluid contents to be drawn through fluid tube 81 from inlet 87 to outlet 85 unrestricted from a pressure differential. The above-described sealing engagement between stopper 20 and container 110 disables fluid contents in volume 160 of container 110 from leaking between stopper 20 and container 110 and through mouth 134 when stopper 20 is assembled with container 110 as herein described, and the frictional contact and seal between inner surface 54 of stopper part 22 against outer surface 89 of fluid tube 81 disables the fluid contents in volume from leaking between inner surface 54 of stopper part 22 and outer surface 89 of fluid tube 81, all without disabling the fluid contents from being withdrawn from volume 160 through fluid tube 81 from inlet 87 to outlet 85.

After the fluid contents of container 110 are withdrawn from volume 160, stopper and fluid tube assembly 80 can be forcibly withdrawn from mouth 130, such as by hand. The inherent elastic and resilient material characteristics of stopper 20 enable stopper 20 stopper 20 holding fluid tube 81 to be forcibly withdrawn, such as by hand, from mouth 134, and enables stopper 20 to resume its shape when it is detached or otherwise withdrawn from container 110. Stopper 20 can be repeatedly installed and withdrawn from container 110 as needed.

Figure 14:
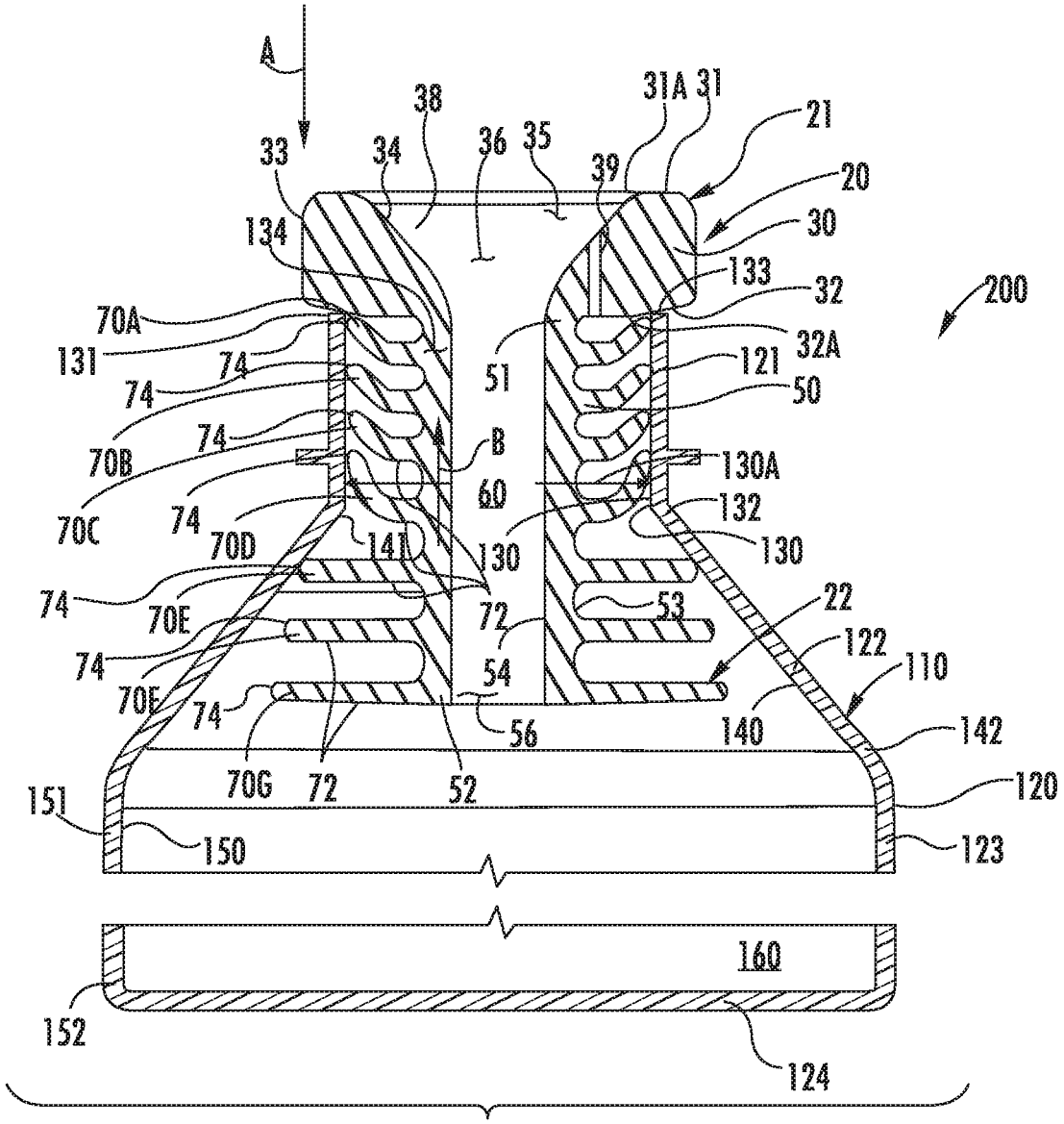
FIG. 14 is a view similar to FIG. 13 illustrating the installation of the stopper with the container without the fluid tube.

FIG. 14 is identical to FIG. 13 in that it illustrates installation/assembly of stopper 20 with the container but without fluid tube 81 in FIG. 13 forming an alternate embodiment of a container assembly denoted at 200. Except for fluid tube 81 in FIG. 13, which is absent in FIG. 14, the same reference characters of FIG. 13 are used in FIG. 14, and the previous discussion of the installation of stopper 20 with container 110 in container assembly 100 applies in every respect to container assembly 200. In the absence of fluid tube 81 in container assembly 200, fluid contents of volume 160 can be simply and conveniently poured outwardly from volume 160 through channel 60 from lower opening 56 to and outwardly from upper opening 35, when container assembly 200 is upended. As described above, stopper 20 restricts fluid contents in volume 160 of container 110 from leaking through mouth 134 past stopper 20 without disabling fluid contents of volume 160 from passing outwardly from volume 160 through channel 60 from lower opening 56 to and outwardly through upper opening 35.

In FIGS. 1-13, stopper 20 is described in conjunction with fluid tube 81 useful for withdrawing fluid contents from a container under suction forming an exemplary stopper and fluid tube assembly 80. The outlet of a fluid tube of a stopper and fluid tube assembly constructed and arranged in accordance with the principle of the invention can be coupled fluidly, i.e. in fluid communication, to a variety of fluid dispensing mechanisms, examples of which are discussed below in §§ D-H.

§ D. Roller Ball Fluid Dispenser and Container Assembly Formed Therewith

Figure 15:
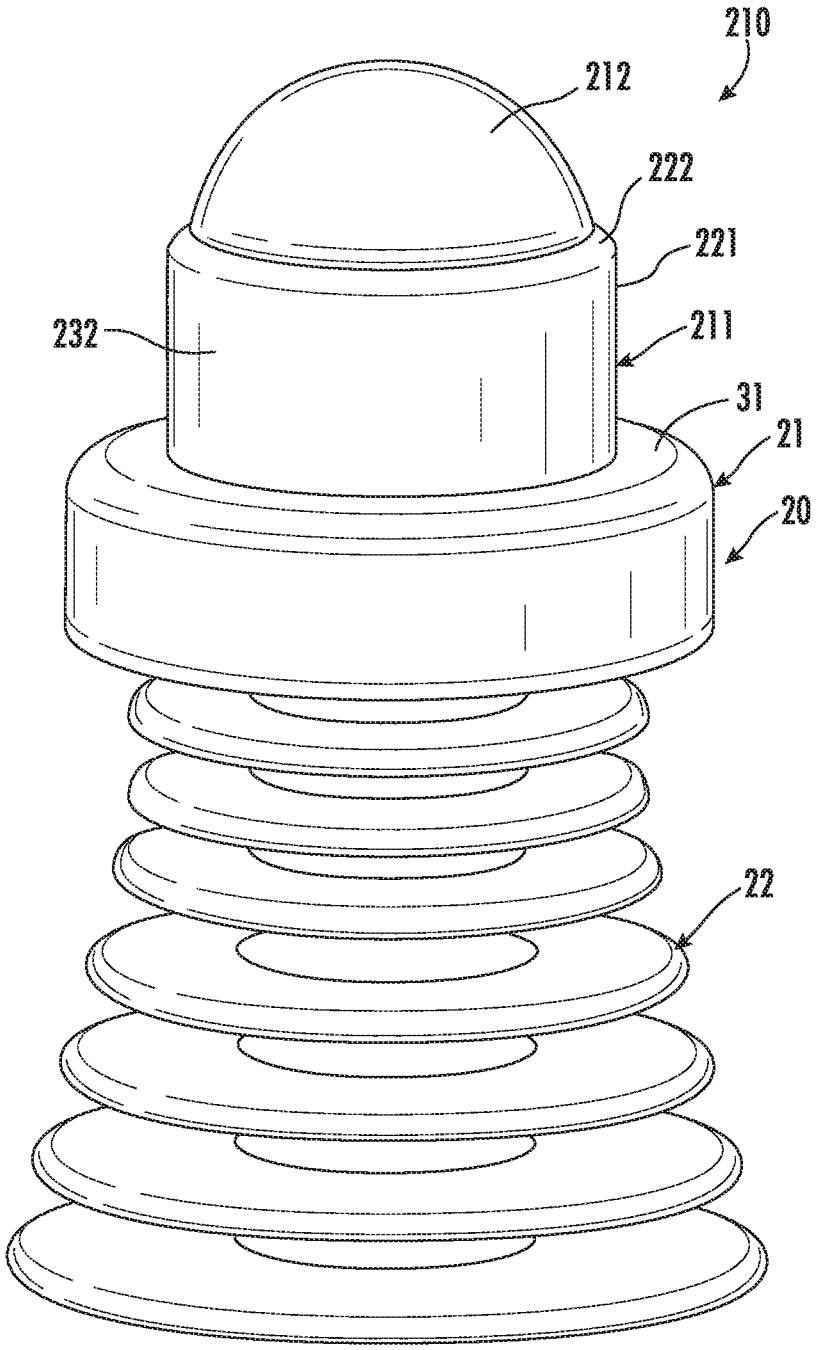
FIG. 15 is a perspective view of a fluid dispensing assembly including the embodiment of FIG. 1 assembled with a roller ball fluid dispensing mechanism.
Figure 16:
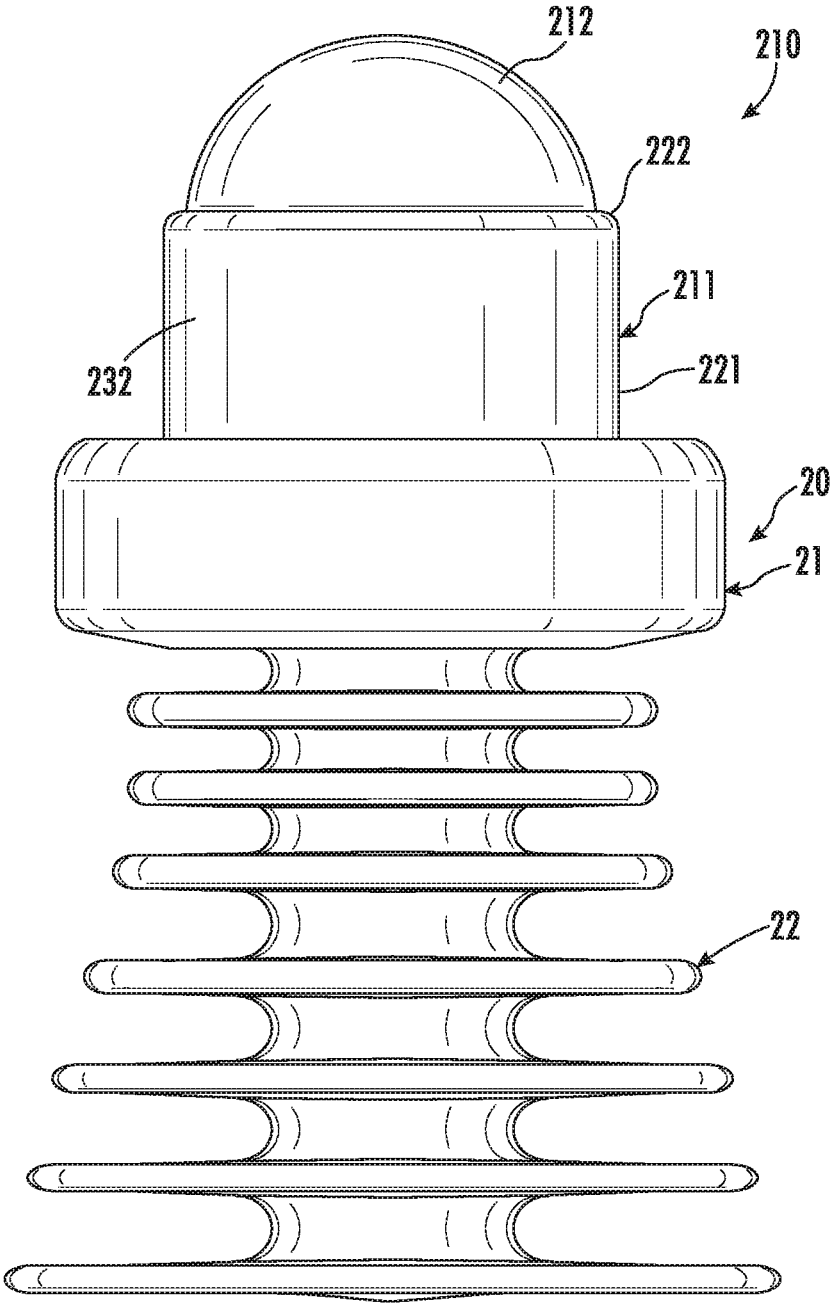
FIG. 16 is a side elevation view of the embodiment of FIG. 15.
Figure 17:
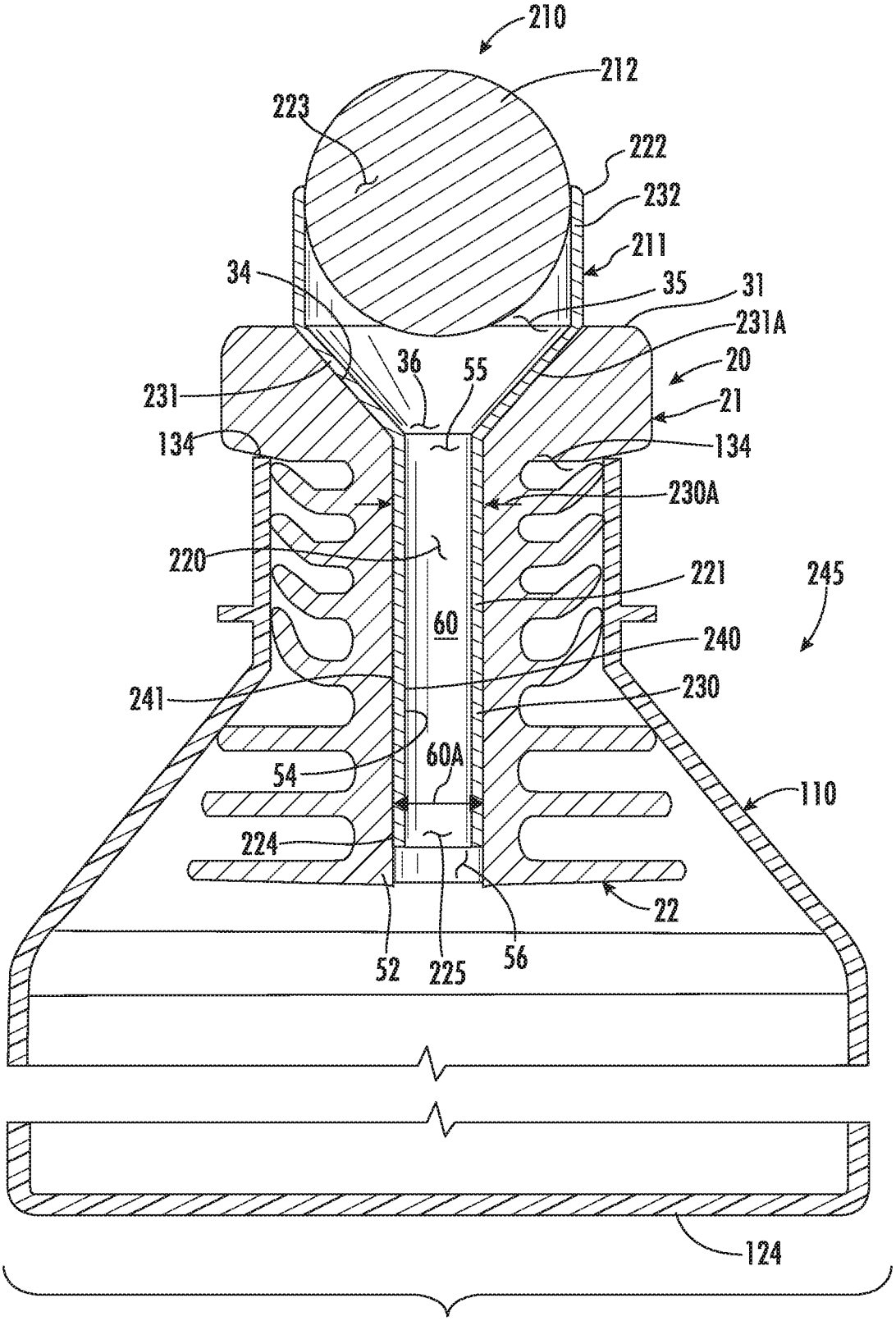
FIG. 17 is an enlarged, fragmentary section view similar to FIG. 13 illustrating the installation of the embodiment of FIGS. 15 and 16 with the container.

FIGS. 15-17 illustrate a fluid dispensing assembly 210 including the previously-described stopper 20 assembled with fluid tube 211 and roller ball 212, which is a type of fluid dispensing mechanism, coupled in fluid communication to fluid tube 211. In FIG. 17, fluid tube 211 is elongate and defines a fluid flow/transfer path 220 therethrough. Fluid tube 211 is an upstanding continuous sidewall 221 having a proximal end 222 forming an outlet 223, and an opposing distal end 224 forming an inlet 225. Ball 212 is held conventionally and rotatably by sidewall 221 proximate to proximal end 222 at outlet 223. Outlet 223 and inlet 225 enable liquids/fluids to be pass through path 220 of fluid tube 211 from distal end 224 to ball 212 at proximal end 222.

Fluid tube 211 defines cylindrical part 230, frustum, and cradle 232. Cylindrical part 230 extends upright from distal end 224 to frustum 231, which extends outwardly and upwardly to cradle 232, which extends upright to proximal end 222. Ball 212 held rotatably by cradle 232 proximate to proximal end 222. Fluid tube 211 has inner surface 240 and outer surface 241 that extend from proximal end 222 to distal end 224. Inner surface 240 defines fluid transfer path 220 from outlet 223 to inlet 225. Outer surface 241 of cylindrical part 230 from distal end 224 to frustum 231 defines outer diameter 230A of cylindrical part 230 of fluid tube 211, and outer surface 241 of frustum 231 defines frustoconical outer periphery 231A of frustum 231 of fluid tube 211. Outer diameter 230A corresponds to inner diameter 60A of channel 60 of stem 50 of stopper part 22. Frustoconical outer periphery 231A of frustum 230 corresponds to frustum 38 inner surface 34.

In assembly 210, fluid tube 211 is inserted into channel 60 of stopper 20, in which cylindrical part 230 extends upright through channel 60 from distal end 224, which, in this example, is inboard of lower opening 56 of lower end 52, to frustum 231 at openings 55 and 36. Frustum 231 extends upwardly through head part 21 of channel 60 from openings 55 and 36 to upper opening 35 and to cradle 232, and cradle 232 extends outwardly from frustum 231, upper opening 35, and upper end 31, also seen in FIGS. 15 and 16, to proximal end 222 that holds ball 212 rotatably at outlet 223 adjacent to upper opening 35 so as to be coupled in fluid communication with ball 212. In FIG. 17, inner surface 54 of stopper part 22 between head part 21 and lower end 52 of stopper part 22 frictionally and sealing engages outer surface 241 of cylindrical part 230 of fluid tube 211 between lower end 52 of stopper part 22 and frustum 231 at head part 21, frictionally retaining and sealing fluid tube cylindrical part 230 of fluid tube 211 to stopper 20, and frustoconical outer periphery 231A of frustum 231 conformingly and sealing engages frustum 38 inner surface 34 of head part 21 from openings 55 and 36 to upper opening 35, frictionally retaining and sealing frustum 231 of fluid tube 211 to stopper 20. Fluid tube 211 enables fluid contents to be withdrawn from the volume 160 of container 110 via fluid transfer path 220 from inlet 225 to ball 212 at outlet 223. The inherent elasticity of stopper 20 enables stopper 20 to yield when stopper 20 and fluid tube 211 are assembled, and enables inner surfaces 34 and 54 to frictionally engage frustoconical outer periphery 231A of frustum 231 and outer surface 241 of cylindrical part 230, respectively, to frictionally hold and seal fluid tube 211 to stopper 20.

FIG. 17 is identical to FIG. 13 in that it illustrates installation/assembly of stopper 20 with the container 110 but without fluid tube 81 in FIG. 13 and instead with fluid tube 211 and ball 212 forming an alternate embodiment of a container assembly 245. The previous discussion of the installation of stopper 20 with container 110 in container assembly 100 applies in every respect to assembly 245. In assembly 235, fluid tube 211 is held by stopper 20 which, in turn, is held by container 110. In assembly 235, fluid contents of volume 160 can be simply and conveniently dispensed outwardly from volume 160 through fluid flow path 220 from inlet 225 to ball 212 at outlet 223, when container assembly 245 is upended and ball 212 is rolled across a surface. As previously described, stopper 20 restricts fluid contents in volume 160 of container 110 from leaking through mouth 134 past stopper 20 without disabling fluid contents of volume 160 from passing outwardly from volume 160 through channel 60 via fluid tube 211 from lower opening 56 to and outwardly through upper opening 35 to ball 212. When assembly 245 is inverted, fluid from volume 160 flows by gravity into channel 60 through lower opening 56, into path 220 through inlet 225, and through path 220 from inlet to ball 212 at outlet 223. Ball 212 contacts and picks up the fluid at upper opening 35 and rotates it outwardly through outlet 223 and onto a surface, when ball 212 is rotated against the surface. Assembly 210 can be readily removed from container 110 by withdrawing stopper 20 from container 110, i.e. by pulling apart stopper 20 and container 110, and assembly 210 can be readily disassembled, such as for cleaning, simply by withdrawing fluid tube 211 from stopper 20, i.e. by pulling apart fluid tube 211 and stopper 20. The sealing engagement between stopper 20 and container 110 disables fluid contents in volume 160 of container 110 from leaking between stopper 20 and container 110 and through mouth 134 when stopper 20 is assembled with container 110 in assembly 245, and the frictional contact and seal between inner surfaces 34 and 54 frustoconical outer periphery 231A of frustum 231 and outer surface 241 of cylindrical part 230, respectively, disables the fluid contents in volume 160 from leaking between inner surfaces 34 and 54 frustoconical outer periphery 231A of frustum 231 and outer surface 241 of cylindrical part 230, respectively, all without disabling the fluid contents from being withdrawn from volume 160 through fluid tube 211 from inlet 225 to outlet 223.

§ E. Pump Fluid Dispenser and Container Assembly Formed Therewith

Figure 18:
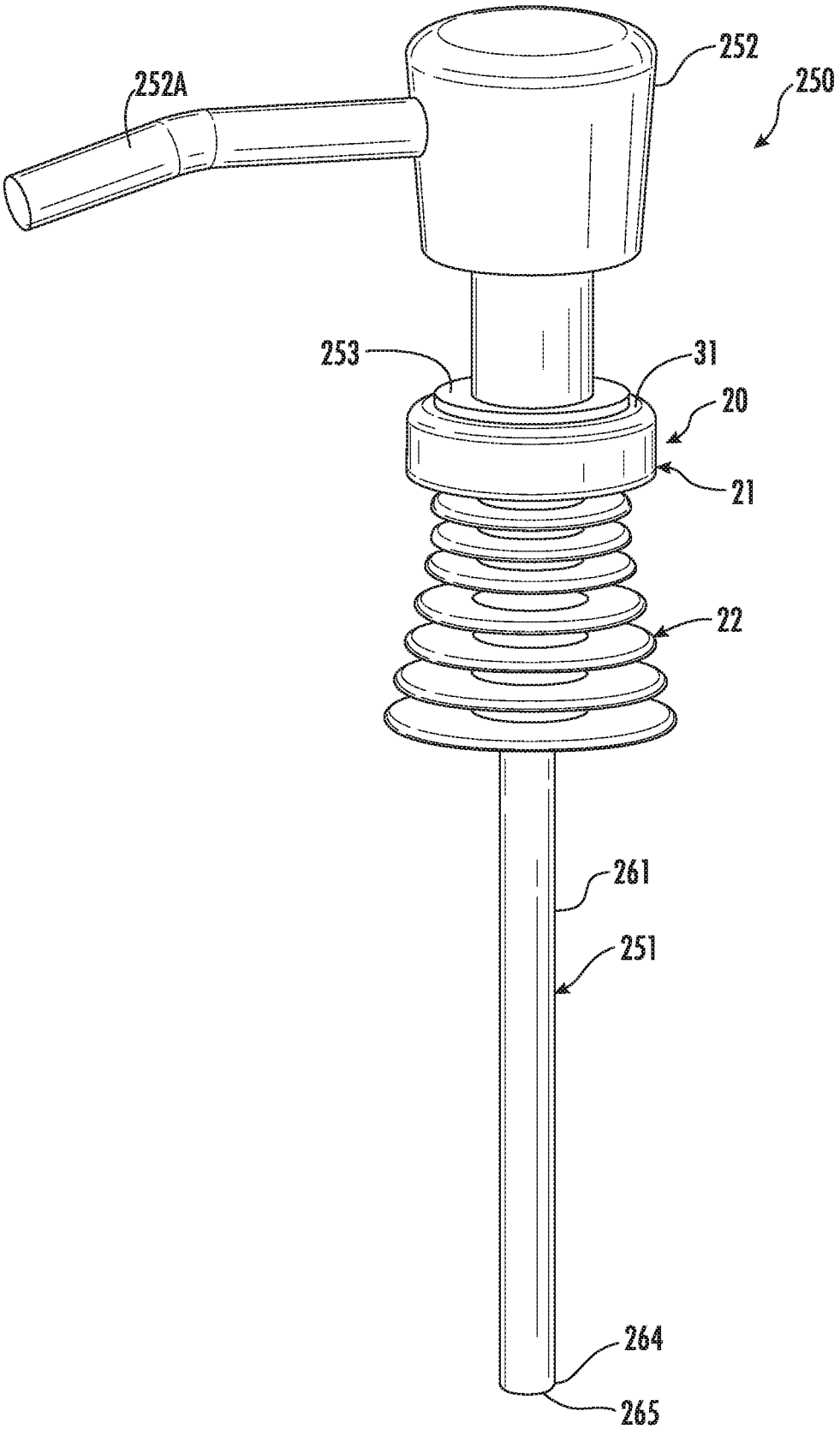
FIG. 18 is a perspective view of another embodiment of a fluid dispensing assembly including the embodiment of FIG. 1 assembled with a pump fluid dispensing mechanism.
Figure 19:
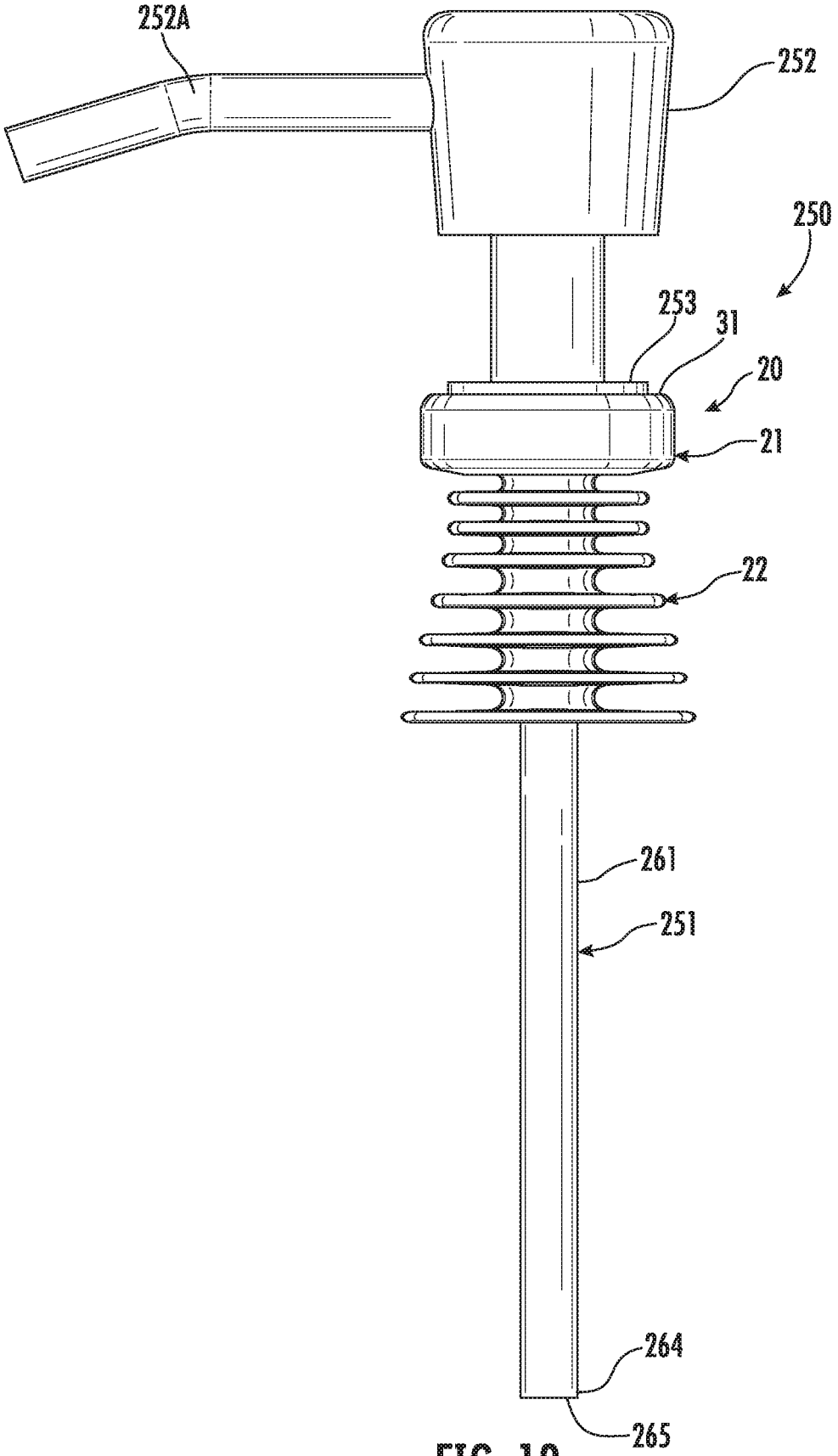
FIG. 19 is a side elevation of the embodiment of FIG. 18.
Figure 20:
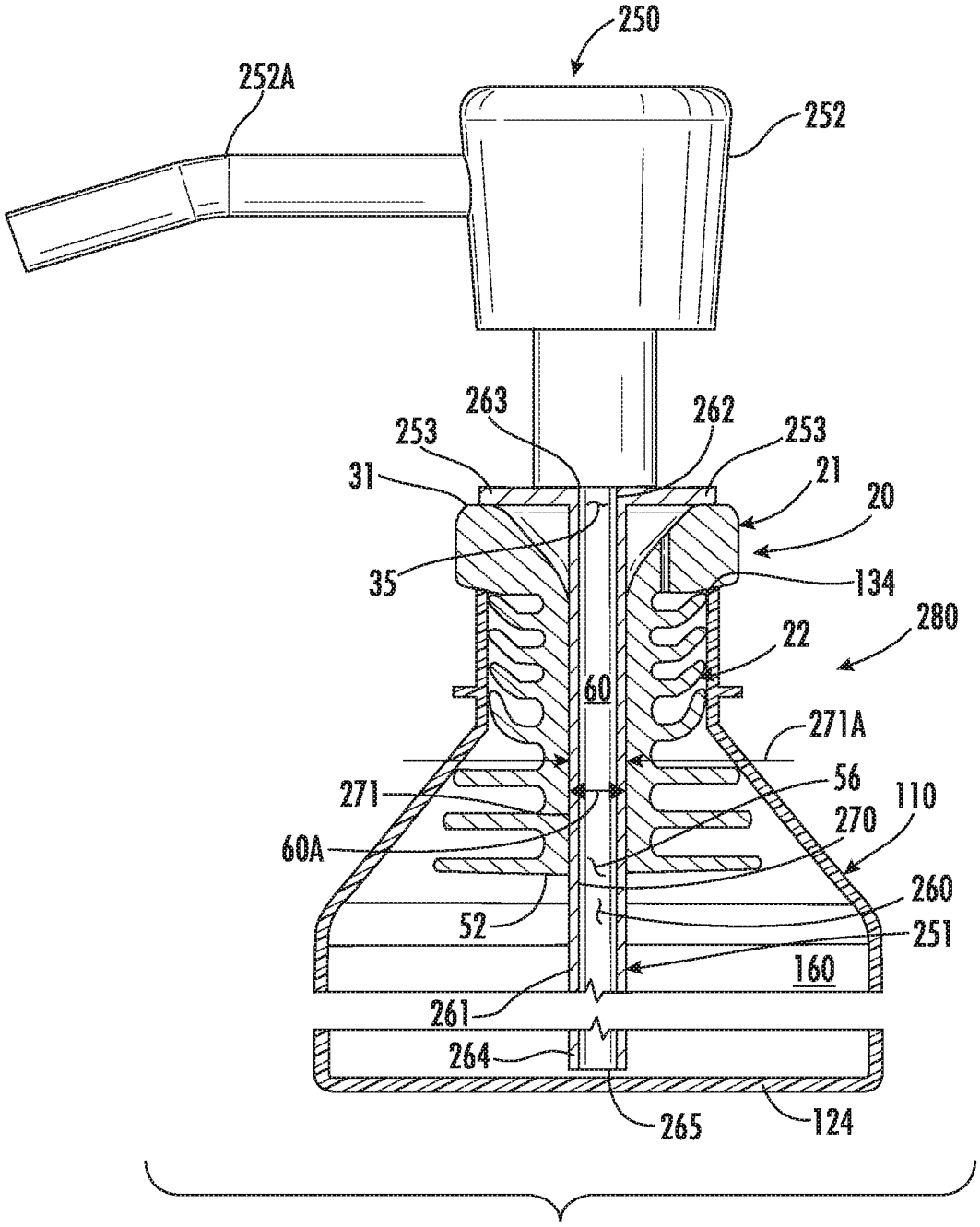
FIG. 20 is an enlarged, fragmentary, partial section view similar to FIG. 13 illustrating the installation of the embodiment of FIGS. 18 and 19 with the container.

FIGS. 18-20 illustrates a fluid dispensing assembly 250 including the previously-described stopper 20 assembled with fluid tube 251 and fluid pump 252, which is another type of fluid dispensing mechanism, coupled in fluid communication to fluid tube 251. Fluid tube 251 is elongate and defines a fluid flow/transfer path 260 therethrough. Fluid tube 251 is an upstanding continuous sidewall 261 having a proximal end 262 forming an outlet 263, and an opposing distal end 264 forming an inlet 265. Proximal end 262 extends into fluid pump 252. Outlet 263 and inlet 265 enable liquids/fluids to pass through path 260 of fluid tube 251 from distal end 264 to fluid pump 252 at proximal end 262.

Fluid tube 251 is cylindrical, and extends upright from distal end 264 to proximal end 262. Fluid tube 251 has inner surface 270 and outer surface 271 that extend from proximal end 262 to distal end 264. Inner surface 270 defines fluid transfer path 260 from outlet 263 to inlet 265. Outer surface 271 from distal end 264 to proximal end 262 defines outer diameter 271A of fluid tube 251 that corresponds to inner diameter 60A of channel 60 of stem 50 of stopper part 22.

In assembly 250, fluid tube 251 extends upright from distal end 264 and through channel 60 from lower opening 56 of lower end 52 to and through upper opening 35 to outlet 263 of proximal end 262 coupled conventionally in fluid communication with fluid pump 252. Fluid pump 252 includes a flange 253 in direct contact against upper end 31 of head part 21, and extends upright therefrom and from upper opening 35, also seen in FIGS. 18 and 19. In FIG. 20, inner surface 54 of stopper part 22 between head part 21 and lower end 52 of stopper part 22 frictionally and sealing engages outer surface 271 of fluid tube 251 between lower end 52 of stopper part 22 and head part 21, frictionally retaining and sealing fluid tube 251 to stopper 20. Fluid tube 251 enables fluid contents to be withdrawn from the volume 160 of container 110 via fluid transfer path 260 from inlet 265 to fluid pump 252 at outlet 263. The inherent elasticity of stopper 20 enables stopper 20 to yield when stopper 20 and fluid tube 251 are assembled, and enables inner surface 54 to frictionally engage outer surface 271 of fluid tube 251 to frictionally hold and seal fluid tube 251 to stopper 20.

FIG. 20 is identical to FIG. 13 in that it illustrates installation/assembly of stopper 20 with the container 110 but without fluid tube 81 in FIG. 13 and instead with fluid tube 251 and fluid pump 252 forming an alternate embodiment of a container assembly 280. The previous discussion of the installation of stopper 20 with container 110 in container assembly 100 applies in every respect to assembly 280. In container assembly 280, fluid tube 251 is held by stopper 20 which, in turn, is held by container 110. Fluid tube 251 extends upright through volume 160 from inlet 265 of distal end 264 in volume 160 proximate to bottom 124 to and through channel 60 of stopper 20 from lower opening 56 of stopper part 20 outwardly from volume 160 through mouth 134 to upper opening 35 of head part 21 and outwardly from upper opening 35 of head part 21 and container 110 to outlet 263 of proximal end 262 coupled fluidly to fluid pump 252, in which inner surface 54 of stopper part 22 between head part 21 and lower end 52 of stopper part 22 frictionally engages outer surface 271 of fluid tube 251 between lower end 52 of stopper part 22 and head part 21 frictionally retaining fluid tube 251 to stopper 20.

In assembly 280, fluid contents of volume 160 can be simply and conveniently dispensed via pumping suction outwardly from volume 160 through fluid flow path 260 from inlet 265 to fluid pump 252 at outlet 263 and outwardly from spout 252A of fluid pump 252, when fluid pump 252 is pumped by hand. As previously described, stopper 20 restricts fluid contents in volume 160 of container 110 from leaking through mouth 134 past stopper 20 without disabling fluid contents of volume 160 from passing outwardly from volume 160 through fluid tube 251 to fluid pump 252. When fluid pump 252 is pumped by hand, fluid from volume 160 flows by suction through path 260 from inlet 265 to outlet 263 and into and outwardly from spout 252A of fluid pump 252. Assembly 250 can be readily removed from container 110 by withdrawing stopper 20 from container 110, i.e. by pulling apart stopper 20 and container 110, and assembly 250 can be readily disassembled, such as for cleaning, simply by withdrawing fluid tube 251 from stopper 20, i.e. by pulling apart fluid tube 251 and stopper 20. The sealing engagement between stopper 20 and container 110 disables fluid contents in volume 160 of container 110 from leaking between stopper 20 and container 110 and through mouth 134 when stopper 20 is assembled with container 110 in assembly 280, and the frictional contact and seal between inner surface 54 of stopper 20 and outer surface 271 of fluid tube 251 disables the fluid contents in volume 160 from leaking between inner surface 54 of stopper 20 and outer surface 271 of fluid tube 251, all without disabling the fluid contents from being withdrawn from volume 160 through fluid tube 251 from inlet 265 to outlet 263 via fluid pump 252.

§ F. Spray Fluid Dispenser and Container Assembly Formed Therewith

Figure 21:
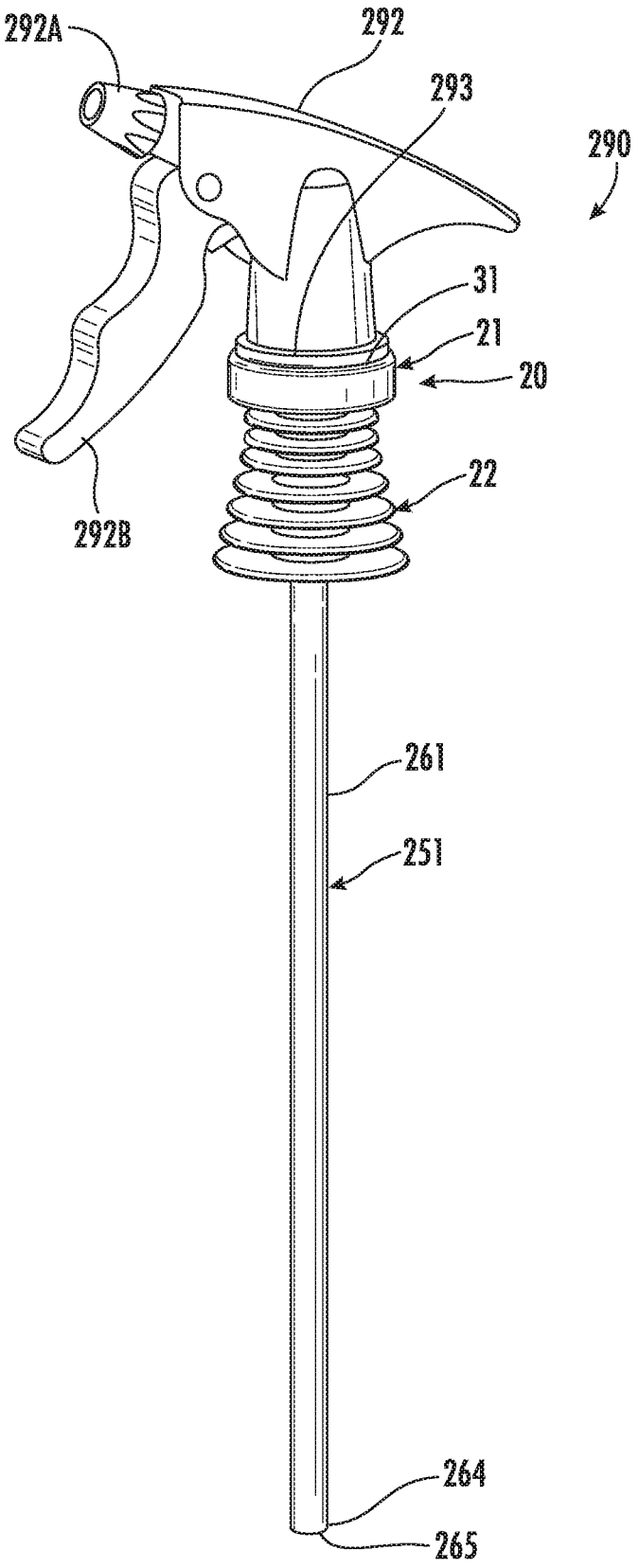
FIG. 21 is a perspective view of yet another embodiment of a fluid dispensing assembly including the embodiment of FIG. 1 assembled with a spray fluid dispensing mechanism.
Figure 22:
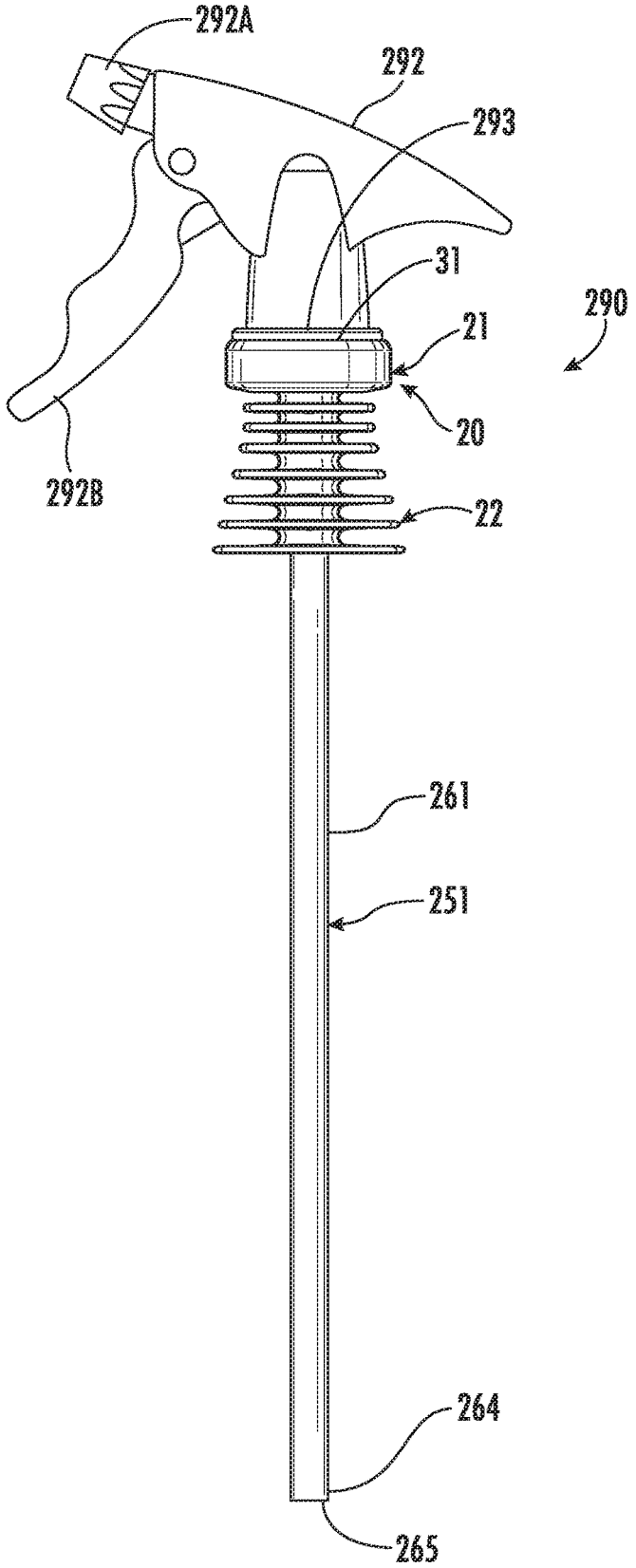
FIG. 22 is a side elevation of the embodiment of FIG. 21.
Figure 23:
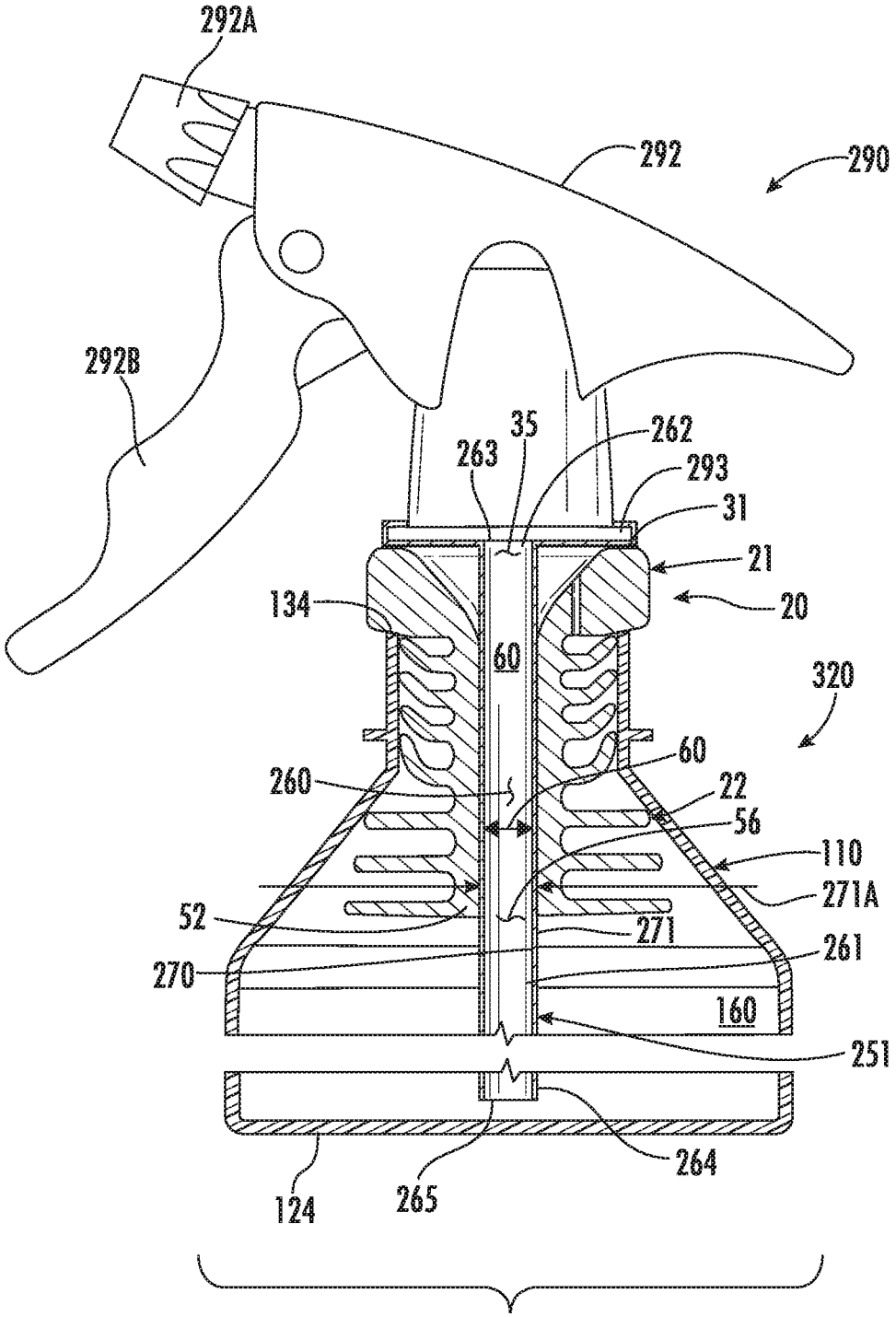
FIG. 23 is an enlarged, fragmentary, partial section view similar to FIG. 13 illustrating the installation of the embodiment of FIGS. 21 and 22 with the container.

FIGS. 21-23 illustrates a fluid dispensing assembly 290 including the previously-described stopper 20 assembled with previously-described fluid tube 251 and spray head 292, which is another type of fluid dispensing mechanism, coupled in fluid communication to fluid tube 251. Fluid tube 251 is elongate and defines fluid flow/transfer path 260 therethrough in FIG. 23. Fluid tube 251 includes upstanding continuous sidewall 261 having proximal end 262 forming outlet 263, distal end 264 forming inlet 265, inner surface 270, outer surface 271, and outer diameter 271A. Proximal end 262 extends into spray head 292. Outlet 263 and inlet 265 enable liquids/fluids to pass through path 260 of fluid tube 251 from distal end 264 to spray head 292 at proximal end 262.

Spray head 292 is conventional. Fluid tube 251 extends upright from distal end 264 to proximal end 262. In assembly 290, fluid tube 251 extends upright from distal end 264 and through channel 60 from lower opening 56 of lower end 52 to and through upper opening 35 to cradle outlet 263 of proximal end 262 coupled conventionally in fluid communication with spray head 292. Spray head 292 includes flange 293 in direct contact against upper end 31 of head part 21, and extends upright therefrom and from upper opening 35, also seen in FIGS. 21 and 22. In FIG. 23, inner surface 54 of stopper part 22 between head part 21 and lower end 52 of stopper part 22 frictionally and sealing engages outer surface 271 of fluid tube 251 between lower end 52 of stopper part 22 and head part 21, frictionally retaining and sealing fluid tube 251 to stopper 20. Fluid tube 251 enables fluid contents to be withdrawn from the volume 160 of container 110 via fluid transfer path 260 from inlet 265 to spray head 292 at outlet 263. The inherent elasticity of stopper 20 enables stopper 20 to yield when stopper 20 and fluid tube 251 are assembled, and enables inner surface 54 to frictionally engage outer surface 271 of fluid tube 251 to frictionally hold and seal fluid tube 251 to stopper 20.

FIG. 23 is identical to FIG. 13 in that it illustrates installation/assembly of stopper 20 with the container 110 but without fluid tube 81 in FIG. 13 and instead with fluid tube 251 and spray head 292 forming an alternate embodiment of a container assembly 320. The previous discussion of the installation of stopper 20 with container 110 in container assembly 100 applies in every respect to assembly 320. In container assembly 320, fluid tube 251 is held by stopper 20 which, in turn, is held by container 110. Fluid tube 251 extends upright through volume 160 from inlet 265 of distal end 264 in volume 160 proximate to bottom 124 to and through channel 60 of stopper 20 from lower opening 56 of stopper part 20 outwardly from volume 160 through mouth 134 to upper opening 35 of head part 21 and outwardly from upper opening 35 of head part 21 and container 110 to outlet 263 of proximal end 262 coupled fluidly to spray head 292, in which inner surface 54 of stopper part 22 between head part 21 and lower end 52 of stopper part 22 frictionally engages outer surface 271 of fluid tube 251 between lower end 52 of stopper part 22 and head part 21 frictionally retaining fluid tube 251 to stopper 20.

In assembly 320, fluid contents of volume 160 can be simply and conveniently dispensed via pumping suction outwardly from volume 160 through fluid flow path 260 from inlet 265 to spray head 292 at outlet 263 and outwardly from spray nozzle 292A of spray head 292, when spray head 292 is pumped conventionally by hand via the spray head 292 pump lever 292B. As previously described, stopper 20 restricts fluid contents in volume 160 of container 110 from leaking through mouth 134 past stopper 20 without disabling fluid contents of volume 160 from passing outwardly from volume 160 through fluid tube 251 to spray head 292. Fluid from volume 160 flows by suction through path 260 from inlet 265 to outlet 263 and into spray head 292 and outwardly through its spray nozzle 292A, when lever 292B of spray head 292 is pumped by hand. Assembly 290 can be readily removed from container 110 by withdrawing stopper 20 from container 110, i.e. by pulling apart stopper 20 and container 110, and assembly 290 can be readily disassembled, such as for cleaning, simply by withdrawing fluid tube 251 from stopper 20, i.e. by pulling apart fluid tube 251 and stopper 20. The sealing engagement between stopper 20 and container 110 disables fluid contents in volume 160 of container 110 from leaking between stopper 20 and container 110 and through mouth 134 when stopper 20 is assembled with container 110 in assembly 320, and the frictional contact and seal between inner surface 54 of stopper 20 and outer surface 271 of fluid tube 251 disables the fluid contents in volume 160 from leaking between inner surface 54 of stopper 20 and outer surface 271 of fluid tube 251, all without disabling the fluid contents from being withdrawn from volume 160 through fluid tube 251 from inlet 265 to outlet 263 via spray head 292.

§ G. Pour Fluid Dispenser and Container Assembly Formed Therewith

Figure 24:
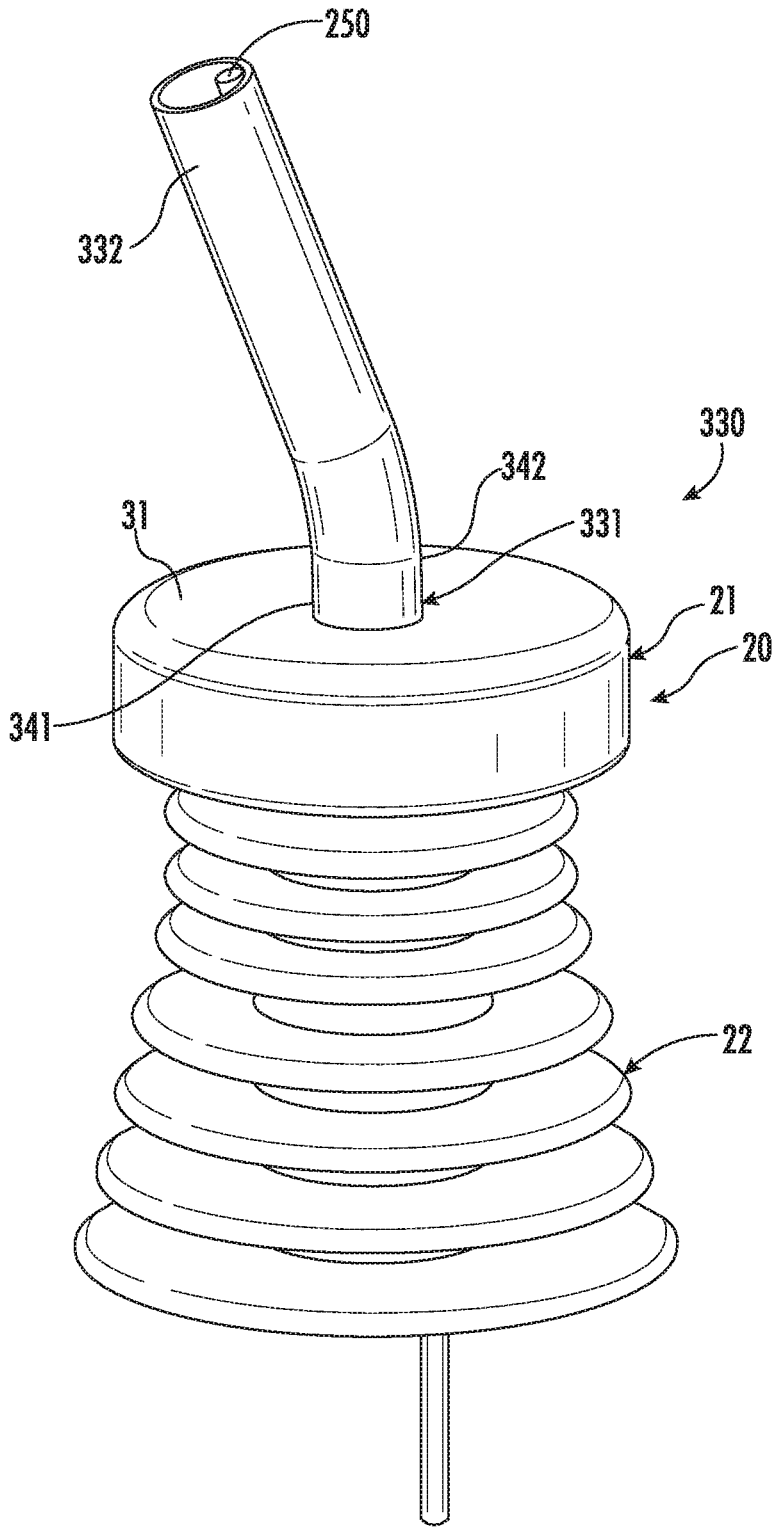
FIG. 24 is a perspective view of still another embodiment of a fluid dispensing assembly including an alternate embodiment of a stopper assembled with a pour fluid dispensing mechanism.
Figure 25:
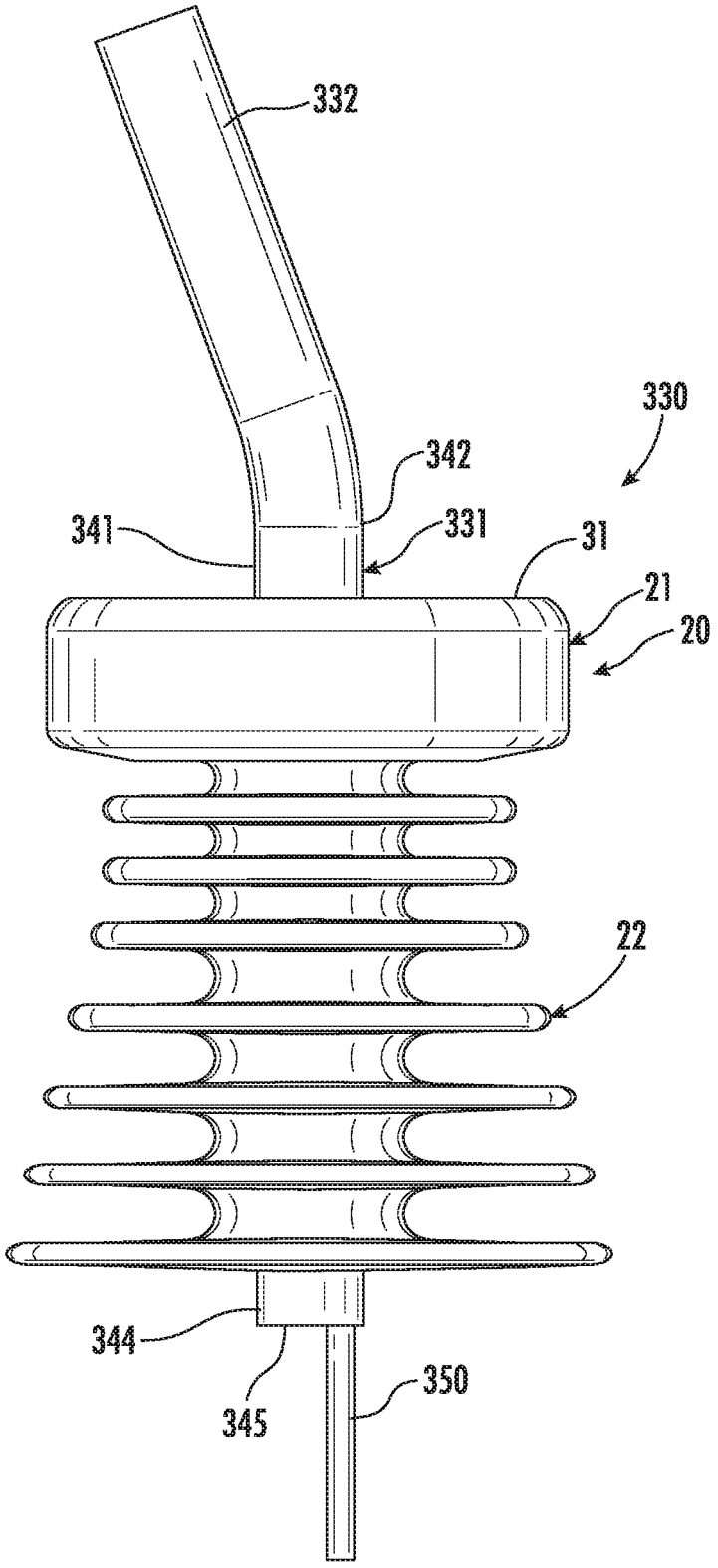
FIG. 25 is a side elevation of the embodiment of FIG. 21.
Figure 26:
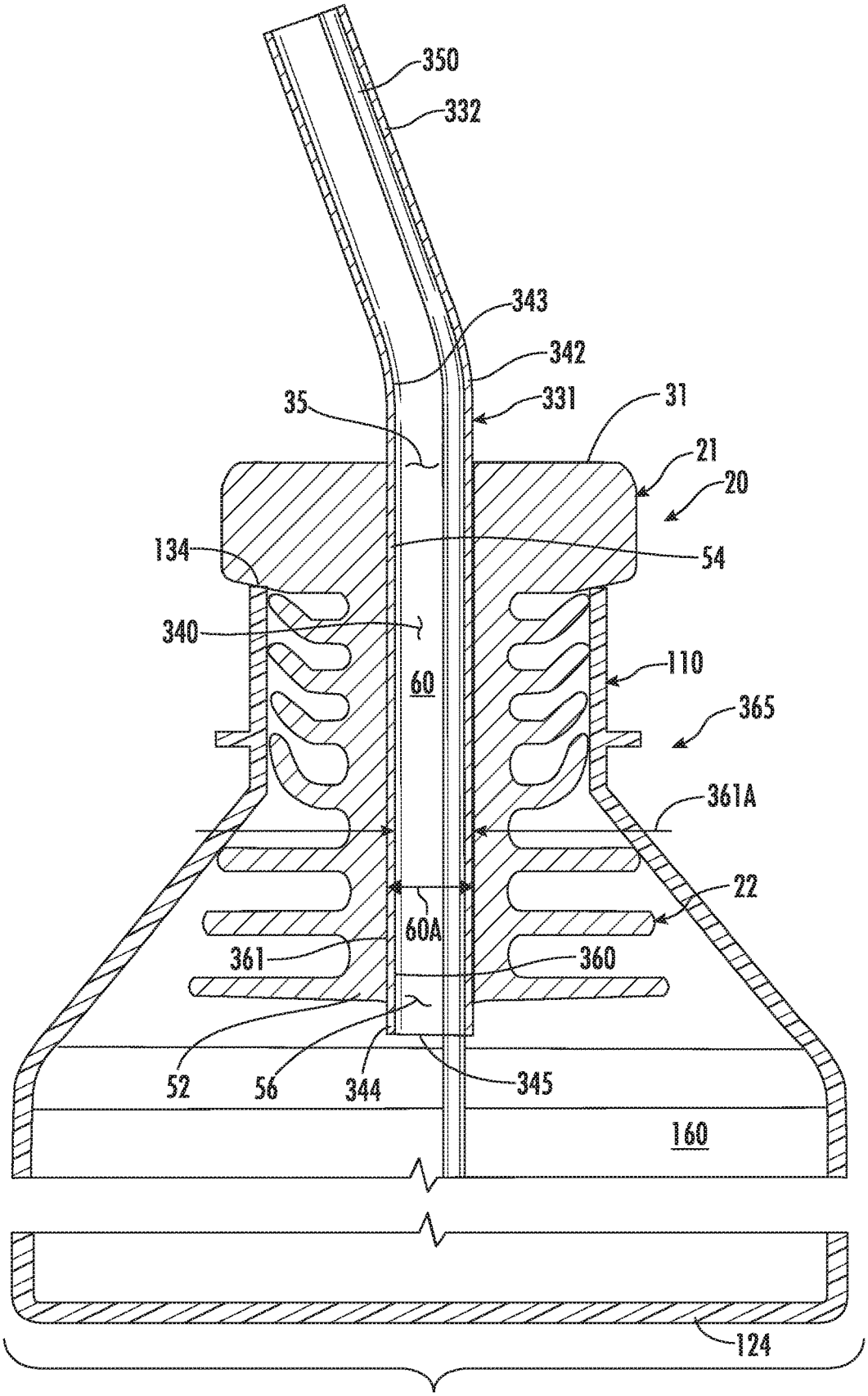
FIG. 26 is an enlarged, fragmentary section view similar to FIG. 13 illustrating the installation of the embodiment of FIGS. 24 and 25 with the container.

FIGS. 24-26 illustrate a fluid dispensing assembly 330 including the previously-described stopper 20 assembled with fluid tube 331 and spout 332, which is a type of fluid dispensing mechanism, coupled in fluid communication to fluid tube 331. In FIG. 26, fluid tube 331 is elongate and defines a fluid flow/transfer path 340 therethrough. Fluid tube 331 is an upstanding continuous sidewall 341 having a proximal end 342 forming an outlet 343, and an opposing distal end 344 forming an inlet 345. Sidewall 341 is integral with spout 332, in which spout 332 is an extension of sidewall 341 that extends from outlet 343 of proximal end 342 coupled in fluid communication to spout 332. Outlet 343 and inlet 345 enable liquids/fluids to be pass through path 340 of fluid tube 331 from distal end 344 to spout 332 at proximal end 342.

Fluid tube 331 extends upright from distal end 344 to proximal end 342, and spout 332 extends upright from proximal end 342 and is angled slightly to one side to enable the convenient pouring of a fluid therefrom. Fluid tube 331 has inner surface 360 and outer surface 361 that extend from proximal end 342 to distal end 344 and to spout 332 from proximal end 342. Inner surface 360 defines fluid transfer path 340 from outlet 343 to inlet 345 and from outlet 343 to spout 332. Breather tube 350 is affixed to inner surface 360, which extends upright into path 340 from inlet 345 and through path 340 to outlet 343 and through spout 332 for regulating pressure between volume of a container and an external environment when fluid flows through path 340 from inlet 345 to outlet 343 and is poured outwardly from spout 332. Outer surface 361 from distal end 344 to proximal end 342 frustum 231 defines outer diameter 361A. Instead of frustum 38, inner surface 54 extends through head part 21 to upper opening 35. Outer diameter 361A corresponds to inner diameter 60A of channel 60 from stem 50 to opening 35 of head part 21.

In assembly 330, fluid tube 331 is inserted into channel 60 of stopper 20 and extends upright from distal end 344 and into channel 60 through lower opening 56 of lower end 52, and upwardly through channel 60 to and through opening 35 and outwardly therefrom and from upper end 31 to proximal 342 at spout 332 coupled in fluid communication to outlet 345 of proximal end 342. In FIG. 26, inner surface 54 from lower opening 56 to upper opening 35 frictionally and sealing engages outer surface 361 of fluid tube 331 between lower end 52 of stopper part 22 and upper end 31 of head part 21, frictionally retaining and sealing fluid tube 331 to stopper 20. Fluid tube 331 enables fluid contents to be withdrawn from volume 160 of container 110 via fluid transfer path 340 from inlet 345 to spout 332 at outlet 343. The inherent elasticity of stopper 20 enables stopper 20 to yield when stopper 20 and fluid tube 331 are assembled, and enables inner surface 54 to frictionally engage outer surface 361 to frictionally hold and seal fluid tube 331 to stopper 20.

FIG. 26 is identical to FIG. 13 in that it illustrates installation/assembly of stopper 20 with the container 110 but without fluid tube 81 in FIG. 13 and instead with fluid tube 331 forming an alternate embodiment of a container assembly 365. The previous discussion of the installation of stopper 20 with container 110 in container assembly 100 applies in every respect to assembly 365. In assembly 365, fluid tube 331 is held by stopper 20 which, in turn, is held by container 110. In assembly 365, fluid contents of volume 160 can be simply and conveniently dispensed outwardly from volume 160 through fluid flow path 340 from inlet 345 to spout 332 at outlet 343, when container assembly 365 is upended. As previously described, stopper 20 restricts fluid contents in volume 160 of container 110 from leaking through mouth 134 past stopper 20 without disabling fluid contents of volume 160 from passing outwardly from volume 160 through channel 60 via fluid tube 331 from lower opening 56 to and outwardly through upper opening 35 to spout 332. When assembly 365 is inverted, fluid from volume 160 flows by gravity into path 340 through inlet 345, and through path 340 from inlet 345 to spout 332 at outlet 343 and outwardly through spout 332 from outlet 343, while at the same time breather tube 350 regulates pressure between volume 160 and the external environment to enable fluid flow through path 340 and outwardly through spout 332 without restriction. Assembly 330 can be readily removed from container 110 by withdrawing stopper 20 from container 110, i.e. by pulling apart stopper 20 and container 110, and assembly 330 can be readily disassembled, such as for cleaning, simply by withdrawing fluid tube 231 from stopper 20, i.e. by pulling apart fluid tube 331 and stopper 20. The sealing engagement between stopper 20 and container 110 disables fluid contents in volume 160 of container 110 from leaking between stopper 20 and container 110 and through mouth 134 when stopper 20 is assembled with container 110 in assembly 365, and the frictional contact and seal between inner surface 54 and outer surface 361 disables the fluid contents in volume 160 from leaking between inner surface 54 and outer surface 361 without disabling the fluid contents from being withdrawn from volume 160 through fluid tube 331 from inlet 345 to outlet 343 and outwardly through spout 332 from outlet 343. The fluid tube 331, spout 332, and breather tube 350 is generally representative of a conventional pour spout assembly commonly used to dispense bottled beverages.

§ H. Push-Pull Fluid Dispenser and Container Assembly Formed Therewith

Figure 27:
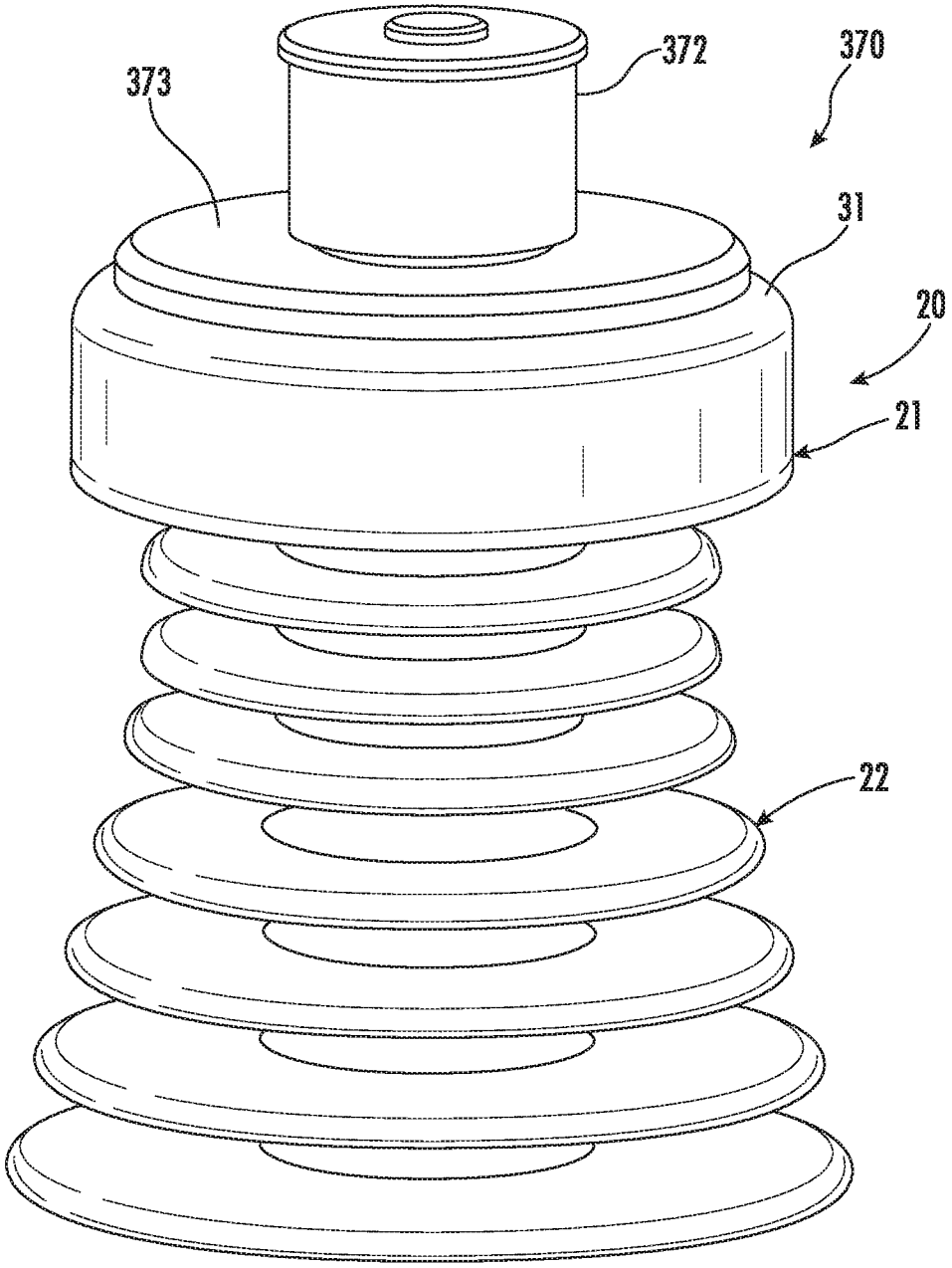
FIG. 27 is a perspective view of yet still another embodiment of a fluid dispensing assembly including the stopper of FIGS. 24-26 assembled with a push-pull fluid dispensing mechanism.
Figure 28:
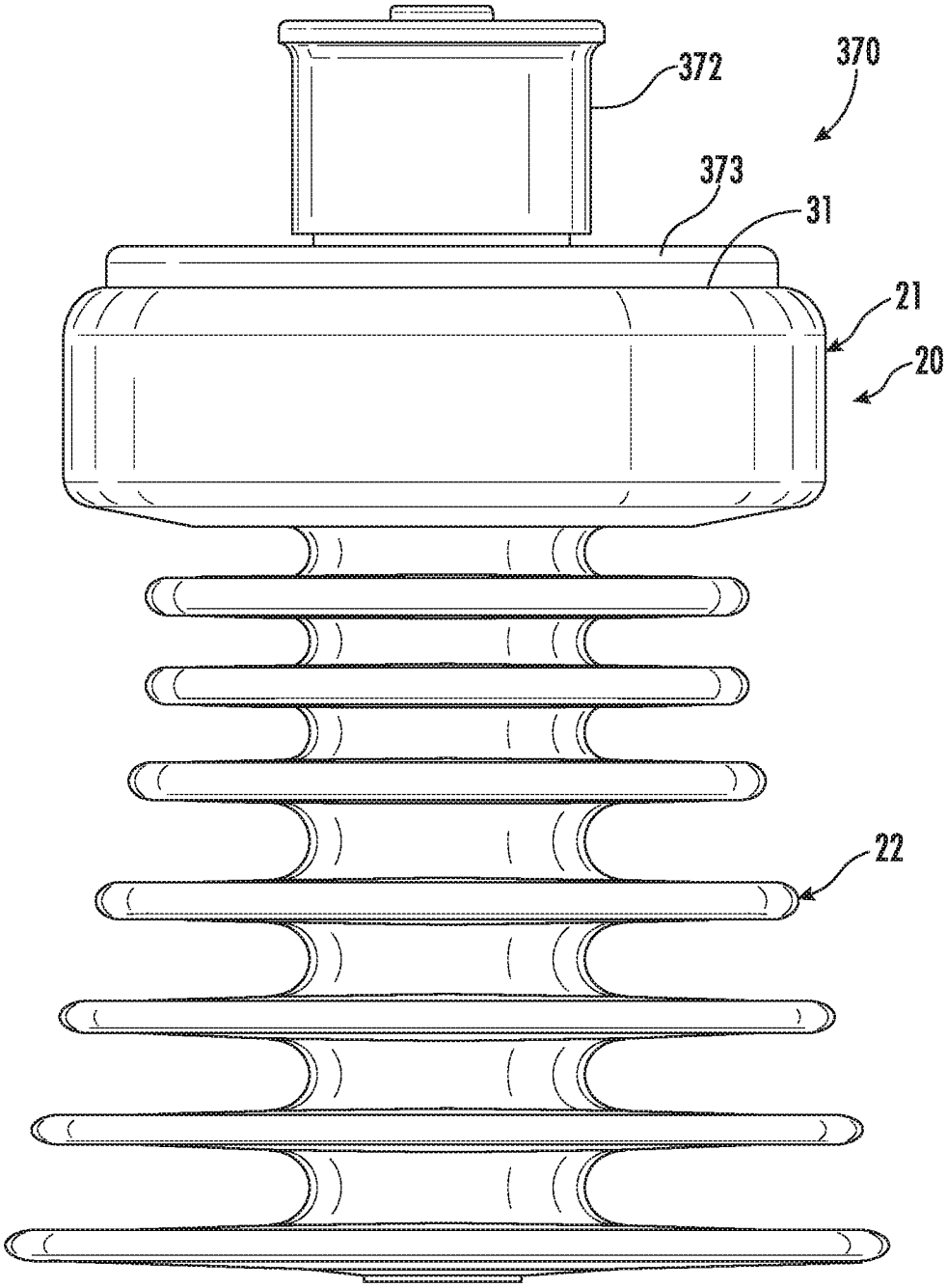
FIG. 28 is a side elevation of the embodiment of FIG. 27.
Figure 29:
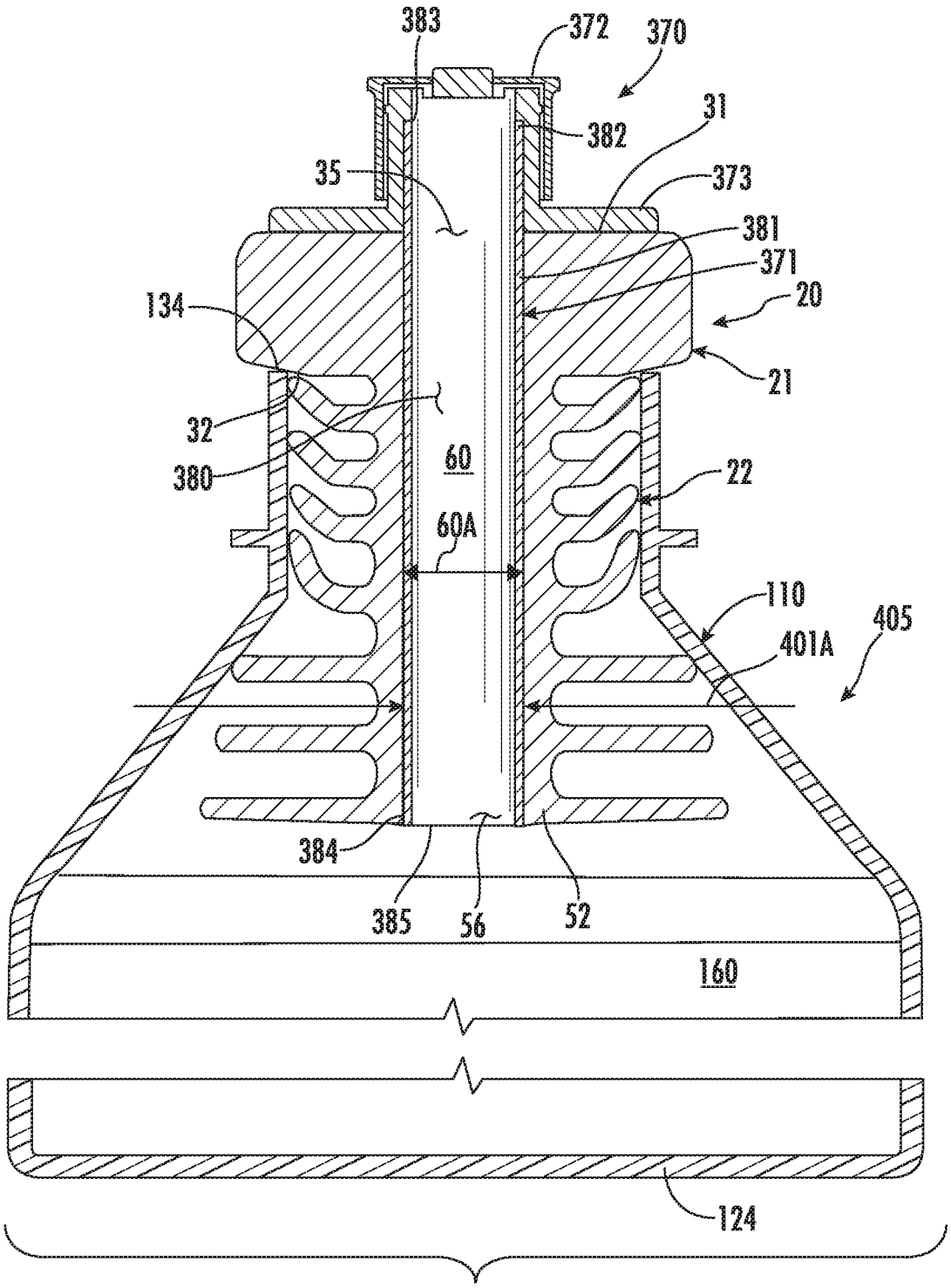
FIG. 29 is an enlarged, fragmentary section view similar to FIG. 13 illustrating the installation of the embodiment of FIGS. 27 and 28 with the container.

FIGS. 27-29 illustrate a fluid dispensing assembly 370 including the previously-described stopper 20 assembled with fluid tube 371 and push-pull head 372, which is a type of fluid dispensing mechanism, coupled in fluid communication to fluid tube 371. In FIG. 29, fluid tube 371 is elongate and defines a fluid flow/transfer path 380 therethrough. Fluid tube 371 is an upstanding continuous sidewall 381 having a proximal end 382 forming an outlet 383 coupled in fluid communication to push-pull head 372, and an opposing distal end 384 forming an inlet 385. Outlet 383 and inlet 385 enable liquids/fluids to be pass through path 380 of fluid tube 371 from distal end 384 to push-pull head 372 at proximal end 382. Push-pull head 272 is conventional and is closed when it is pushed inwardly by hand, and is open when it is pulled outwardly by hand.

Fluid tube 371 extends upright from distal end 384 to proximal end 382, and push-pull head 372 extends upright from proximal end 382. Fluid tube 371 has inner surface 400 and outer surface 401 that extend from proximal end 382 to distal end 384. Inner surface 400 defines fluid transfer path 380 from outlet 383 to inlet 385. Outer surface 401 from distal end 384 to proximal end 382 frustum 231 defines outer diameter 401A. Instead of frustum 38, inner surface 54 extends through head part 21 to upper opening 35. Outer diameter 401A corresponds to inner diameter 60A of channel 60 from stem 50 to opening 35 of head part 21.

In assembly 370, fluid tube 371 is inserted into channel 60 of stopper 20 and extends upright from distal end 384 adjacent to lower opening 56 through channel 60 to and through opening 35 and outwardly therefrom and from upper end 31 to proximal 382 at push-pull head 372 coupled in fluid communication to outlet 385 of proximal end 382. In FIG. 29, inner surface 54 from lower opening 56 to upper opening 35 frictionally and sealing engages outer surface 401 of fluid tube 371 between lower end 52 of stopper part 22 and upper end 31 of head part 21, frictionally retaining and sealing fluid tube 371 to stopper 20. Fluid tube 371 enables fluid contents to be withdrawn from volume 160 of container 110 via fluid transfer path 380 from inlet 385 to push-pull head 372 at outlet 383. The inherent elasticity of stopper 20 enables stopper 20 to yield when stopper 20 and fluid tube 371 are assembled, and enables inner surface 54 to frictionally engage outer surface 401 to frictionally hold and seal fluid tube 371 to stopper 20.

FIG. 29 is identical to FIG. 13 in that it illustrates installation/assembly of stopper 20 with the container 110 but without fluid tube 81 in FIG. 13 and instead with fluid tube 371 forming an alternate embodiment of a container assembly 405. The previous discussion of the installation of stopper 20 with container 110 in container assembly 100 applies in every respect to assembly 405. In assembly 405, fluid tube 371 is held by stopper 20 which, in turn, is held by container 110. Push-pull head 372 includes flange 373 in direct contact against upper end 31 of head part 21, and extends upright therefrom and from upper opening 35, also seen in FIGS. 27 and 28.

In assembly 405, fluid contents of volume 160 can be simply and conveniently dispensed outwardly from volume 160 through fluid flow path 380 from inlet 385 to push-pull head 372 at outlet 383, when container assembly 405 is upended and container 110 is squeezed. In this embodiment, container 110 is a squeeze bottle, is known type of container for dispensing a fluid from push-pull head 372 when it is open and that is powered by squeezing the container by exerting pressure with the user's hand. As previously described, stopper 20 restricts fluid contents in volume 160 of container 110 from leaking through mouth 134 past stopper 20 without disabling fluid contents of volume 160 from passing outwardly from volume 160 through channel 60 via fluid tube 371 from lower opening 56 to and outwardly through upper opening 35 to push-pull head 372. When assembly 405 is inverted, fluid from volume 160 flows by gravity into path 380 through inlet 385, and through path 380 from inlet 385 to push-pull head 372 at outlet 383 and outwardly through push-pull head 372 from outlet 383. Assembly 370 can be readily removed from container 110 by withdrawing stopper 20 from container 110, i.e. by pulling apart stopper 20 and container 110, and assembly 370 can be readily disassembled, such as for cleaning, simply by withdrawing fluid tube 371 from stopper 20, i.e. by pulling apart fluid tube 371 and stopper 20. The sealing engagement between stopper 20 and container 110 disables fluid contents in volume 160 of container 110 from leaking between stopper 20 and container 110 and through mouth 134 when stopper 20 is assembled with container 110 in assembly 405, and the frictional contact and seal between inner surface 54 and outer surface 401 disables the fluid contents in volume 160 from leaking between inner surface 54 and outer surface 401 without disabling the fluid contents from being withdrawn from volume 160 through fluid tube 371 from inlet 385 to outlet 383 and outwardly through push-pull head 372 from outlet 383.

§ I. Stopper and Container Assembly Formed Therewith

Figure 30:
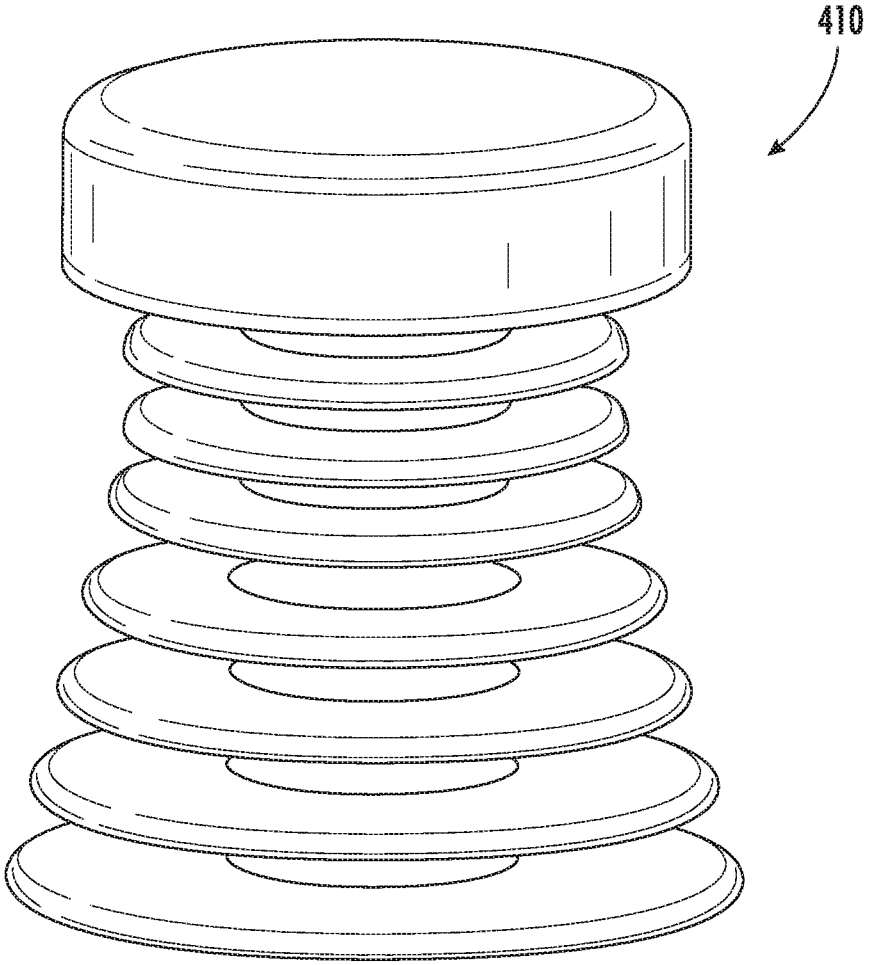
FIG. 30 is a perspective view of another embodiment of a stopper.
Figure 31:
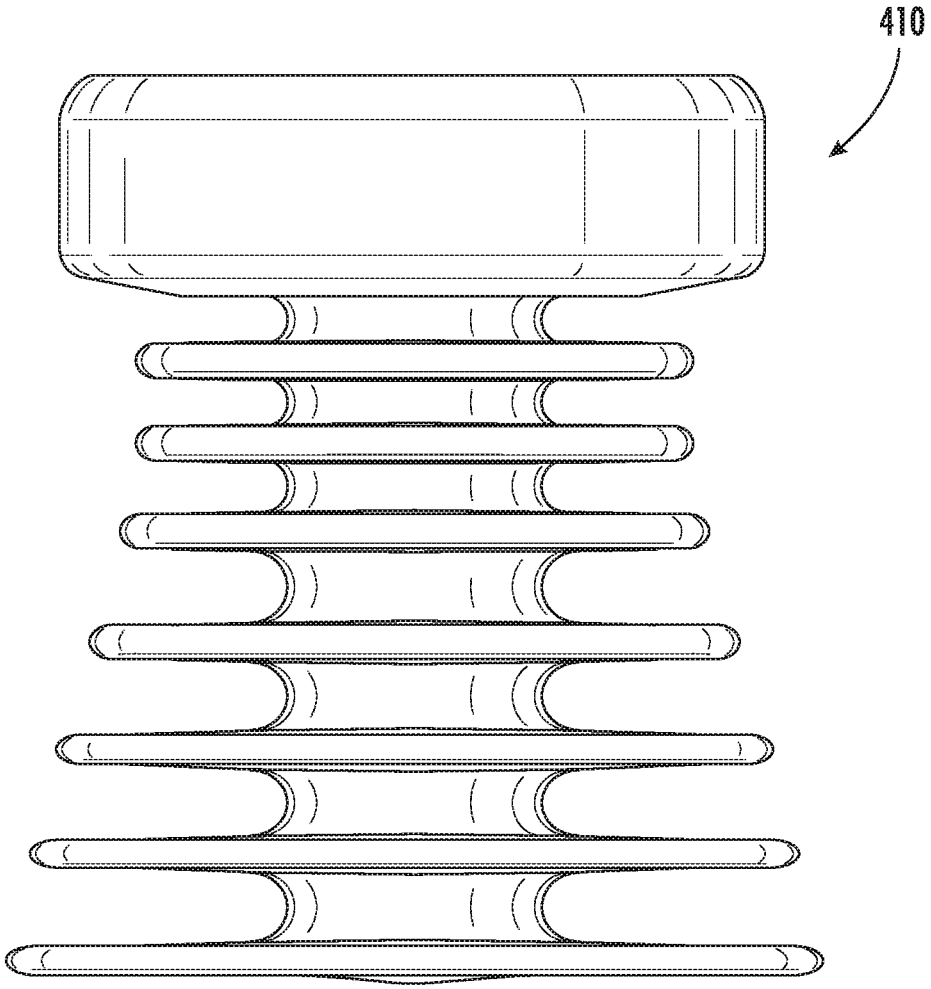
FIG. 31 is a side elevation of the embodiment of FIG. 30.
Figure 32:
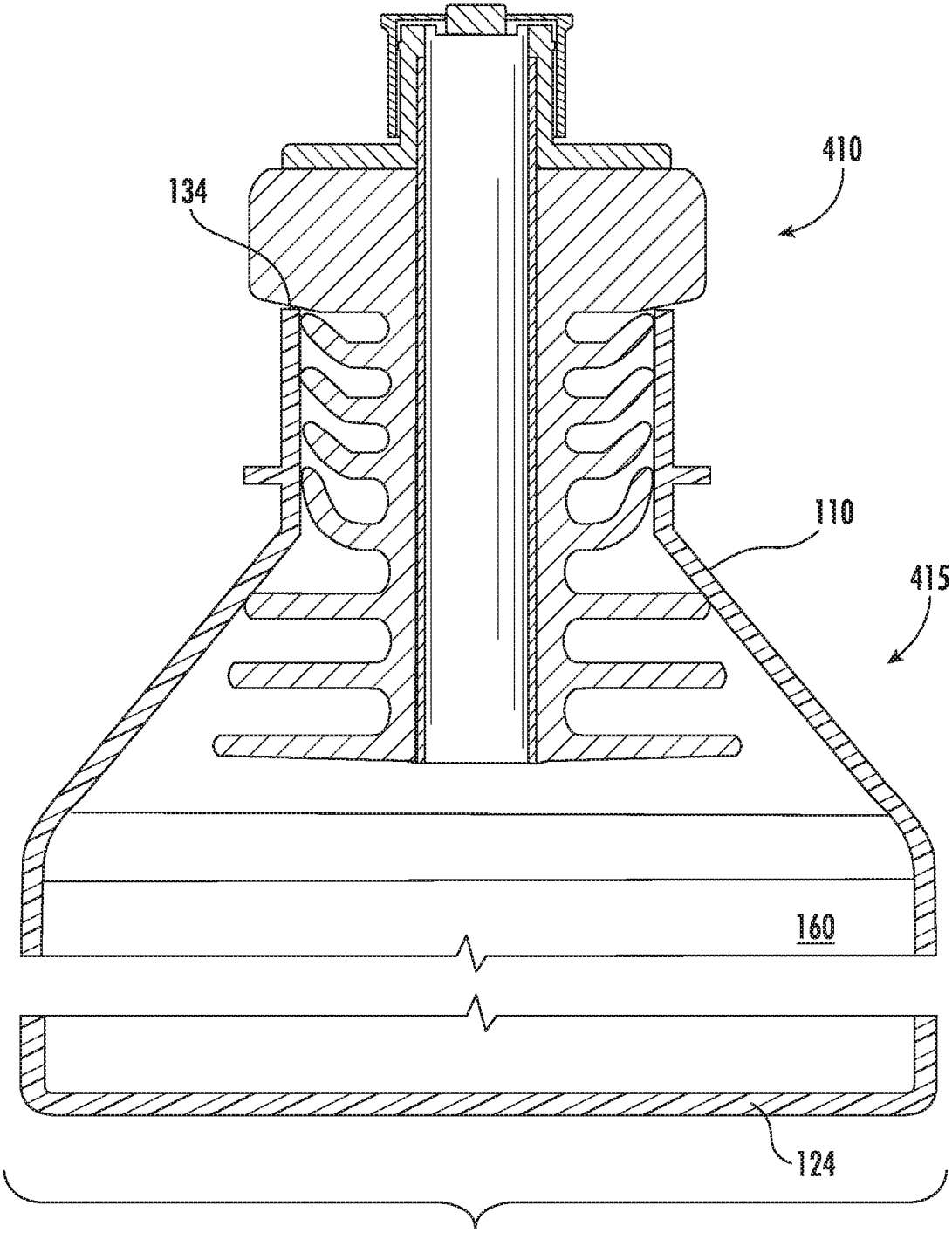
FIG. 32 is an enlarged, fragmentary section view similar to FIG. 13 illustrating the installation of the embodiment of FIGS. 30 and 31 with the container.

In all previously described embodiments, the various stoppers are hollow, each being formed with channel 60, for enabling each of them to be assembled with a fluid tube. FIGS. 30-31 illustrate a stopper 410 that, rather than being hollow, i.e. formed with channel 60, is solid. Other than being solid, stopper 410 is identical in every respect to stopper 20. FIG. 32 is identical to FIG. 13 in that it illustrates installation/assembly of stopper 410 with the container 110 forming an alternate embodiment of a container assembly 415. Being solid, i.e. not hollow being without channel 60, in container assembly 415 stopper 410 seals and closes mouth 134 sealing the fluid contents in volume 160. To open mouth 134 to enable access to the fluid contents in volume 160, stopper 410 need only be withdrawn from mouth 134, such as by pulling it outwardly from mouth 134.

The present invention is described above with reference to illustrative embodiments. Those skilled in the art will recognize that changes and modifications may be made in the described embodiment without departing from the nature and scope of the present invention. Various further changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

The invention claimed is:

1. A container assembly, comprising:

a container comprises a body, the body includes a mouth, a neck, a shoulder, and defines a volume for receiving and holding fluid contents through the mouth, the neck includes a neck inner surface, an upper end that defines the mouth, and a lower end, the neck, including the neck inner surface, extends downwardly from the upper end of the neck to the lower end of the neck, the shoulder includes a shoulder inner surface, an upper end connected to the lower end of the neck, and a lower end, and the shoulder, including the shoulder inner surface, extends downwardly and outwardly from the upper end of the shoulder to the lower end of the shoulder;

a stopper part including an upper end, a lower end, an outer surface, and flanges, the stopper part, including the outer surface of the stopper part, extend downwardly from the upper end of the stopper part to the lower end of the stopper part, each said flange radiates outwardly from the outer surface of the stopper part to an outer periphery that defines an outer diameter, the flanges are spaced apart from proximate to the upper end of the stopper part to proximate to the lower end of the stopper part, and the outer diameters of the flanges are different from one another and increase from an innermost one of the flanges proximate to the upper end of the stopper part to a lowermost one of the flanges proximate to the lower end of the stopper part; and the stopper part is inserted into the volume through the mouth, the stopper part extends downwardly into the volume through the neck from the upper end of the stopper part proximate to the mouth to the lower end of the stopper part beyond the lower end of the neck, at least a first one of the flanges proximate to the neck extends outwardly from the outer surface of the stopper part to the outer periphery thereof engaged sealingly to the neck inner surface, at least a second one of the flanges proximate to the shoulder extends outwardly from the outer surface of the stopper part to the outer periphery thereof engaged sealingly to the shoulder inner surface, wherein the outer diameter of the at least first one of the flanges is less than the outer diameter of the at least second one of the flanges, and the at least first one of the flanges and the at least second one of the flanges hold the stopper to the neck inner surface and to the shoulder inner surface, respectively.

2. The container assembly according to claim 1, wherein:

the stopper part further includes an inner surface that extends downwardly from the upper end of the stopper part to the lower end of the stopper part;

the upper end of the stopper part defines an upper opening;

the lower end of the stopper part defines a lower opening; and the inner surface of the stopper part defines a channel that extends from the upper opening to the lower opening.

3. The container assembly according to claim 2, further comprising:

a fluid tube, the fluid tube includes a continuous sidewall having an inner surface that defines a fluid transfer path, an outer surface, a proximal end that forms an outlet, and an opposing distal end that forms an inlet, the outlet and the inlet enable fluid to pass through the fluid transfer path from the distal end to the proximal end; and the fluid tube extends upright from the distal end to the proximal end through the channel, the inner surface of the stopper part frictionally engages the outer surface of the fluid tube frictionally retaining and sealing the fluid tube to the stopper part, and the fluid tube enables fluid contents to be withdrawn from the volume of the container via the fluid transfer path from the inlet of the fluid tube to the outlet of the fluid tube.

4. The container assembly according to claim 3, wherein the outlet of the proximal end of the fluid tube is coupled in fluid communication to a fluid dispensing mechanism.

5. The container assembly according to claim 1, wherein the stopper part is fashioned of an elastomer.

6. A stopper comprising a stopper part including an upper end, a lower end, an outer surface, and flanges, the stopper part, including the outer surface of the stopper part, extend downwardly from the upper end to the lower end, each said flange radiates outwardly from the outer surface of the stopper part to an outer periphery that defines an outer diameter, the flanges are spaced apart from proximate to the upper end to proximate to the lower end, and the outer diameters of the flanges are different from one another and increase from an innermost one of the flanges proximate to the upper end to a lowermost one of the flanges proximate to the lower end.

7. The stopper according to claim 6, wherein:

the stopper part further includes an inner surface that extends downwardly from the upper end to the lower end;

the upper end defines an upper opening;

the lower end defines a lower opening; and the inner surface of the stopper part defines a channel that extends from the upper opening to the lower opening.

8. The stopper according to claim 6, wherein the stopper is fashioned of an elastomer.

9. A stopper and fluid tube assembly, comprising:

a fluid tube includes a continuous sidewall having an inner surface that defines a fluid transfer path, an outer surface, a proximal end that forms an outlet, and an opposing distal end that forms an inlet, the outlet and the inlet enable fluid to be drawn through the fluid transfer path from the distal end to the proximal end;

a stopper comprising a stopper part including an upper end, a lower end, an outer surface, an inner surface, and flanges, the stopper part, including the outer surface of the stopper part and the inner surface of the stopper part, extend downwardly from the upper end of the stopper part to the lower end of the stopper part, each said flange radiates outwardly from the outer surface of the stopper part to an outer periphery that defines an outer diameter, the flanges are spaced apart from proximate to the upper end of the stopper part to proximate to the lower end of the stopper part, and the outer diameters of the flanges are different from one another and increase from an innermost one of the flanges proximate to the upper end of the stopper part to a lowermost one of the flanges proximate to the lower end of the stopper part;

the upper end of the stopper part defines an upper opening;

the lower end of the stopper part defines a lower opening;

the inner surface of the stopper part defines a channel that extends from upper opening to the lower opening; and the fluid tube extends upright from the distal end to the proximal end through the channel, the inner surface of the stopper part frictionally engages the outer surface of the fluid tube frictionally retaining and sealing the fluid tube to the stopper part, and the fluid tube enables fluid contents to be withdrawn from the volume of the container via the fluid transfer path from the inlet of the fluid tube to the outlet of the fluid tube.

10. The stopper and fluid tube assembly according to claim 9, wherein the outlet of the proximal end of the fluid tube is coupled in fluid communication to a fluid dispensing mechanism.

11. The stopper and fluid tube assembly according to claim 9, wherein the stopper is fashioned of an elastomer.

* * * * *